US006307167B1

(12) United States Patent
Kajio et al.

(10) Patent No.: US 6,307,167 B1
(45) Date of Patent: Oct. 23, 2001

(54) KEY SWITCH

(75) Inventors: Hiroyuki Kajio; Takashi Niwa, both of Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/363,550

(22) Filed: Jul. 29, 1999

(30) Foreign Application Priority Data

Jul. 30, 1998 (JP) ..... 10-215144
Aug. 9, 1998 (JP) ..... 10-253865

(51) Int. Cl.[7] ..... H01H 9/28
(52) U.S. Cl. ..... 200/43.11; 200/43.04
(58) Field of Search ..... 200/43.04, 43.7, 200/43.11

(56) References Cited

U.S. PATENT DOCUMENTS 4,904,829 * 2/1990 Berthaud et al. ..... 200/50 R
4,963,706 10/1990 Mohtasham .
5,181,602 * 1/1993 Kozlowski et al. ..... 200/43.015
5,420,385 * 5/1995 Cooper ..... 200/43.07
5,464,954 * 11/1995 Kimura et al. ..... 200/61.62
5,622,253 * 4/1997 Wecke et al. ..... 200/43.07
5,777,284 * 7/1998 Mohtasham ..... 200/43.04
6,013,881 * 1/2000 Hall et al. ..... 200/43.04
6,037,551 * 3/2000 Fukui et al. ..... 200/43.04
6,118,087 * 9/2000 Fukui ..... 200/43.04

FOREIGN PATENT DOCUMENTS 43 38 910 C1 2/1995 (DE) .
0 755 063 A1 1/1997 (EP) .
303926 * 2/1992 (JP) .

* cited by examiner

*Primary Examiner*—Paula Bradley
*Assistant Examiner*—Nhung Nguyen
(74) *Attorney, Agent, or Firm*—Morrison & Foerster LLP

(57) ABSTRACT

A key switch includes a cam member rotating in accordance with the insertion-and-pull of a key to be inserted into a key insertion opening, a plunger coming into contact with a circumferential cam side of the cam member, a switch mechanism actuated by the plunger which is displaced in accordance with the rotation of the cam member, and a rotation lock mechanism for locking the rotation of the cam member when the key is pulled, in which the rotation lock mechanism including a locking member which can be displaced in the direction parallel to a vertical rotation face on the rotation axis of the cam member and a spring urging the locking member toward a position to be engaged with the cam member, and the locking member being disposed to be displaced to a lock release position by contacting the key resisting the spring.

9 Claims, 30 Drawing Sheets

(a)

(b)

(a)

(b)

(a)

(b)

(a)

(b)

(a)

(b)

(a)

(b)

(a)

(b)

(a)

(b)

KEY SWITCH

BACKGROUND OF THE INVENTION

1. Field of the Invention

This invention relates to a key switch, and particularly to an improved key switch utilized, for example, as a safety switch of a door.

2. Description of the Related Art

A conventional safety switch of a door is mounted in a safety door or a care fence on equipment in order to prevent accidents by unprepared operations or accidental operations beforehand in various machine tools and industry equipment.

This kind of safety switch is designed to be inoperable with a tool, for example, a screw driver, except for an exclusive key, and lock its internal apparatus in an initial condition that the key is pulled out, an example of which is shown in FIGS. 32 and 33.

In this conventional safety switch, cam plate 104 is rotated by the insertion-and-pull-out movement of a key 103 as to a key insertion opening 102, and a plunger 105 coming into contact with a peripheral cam surface of the cam plate 104 is displaced in accordance with the rotational movement of the cam plate 104 so as to switch a switch mechanism (not shown in drawings), and there is provided a rotational lock mechanism for locking the rotation of the cam plate 104 in the initial position when the key 103 is pulled out.

This rotational lock mechanism 106 includes a pair of forward and backward locking members 107 disposed near the periphery of the cam for a forward-and-backward movement in a rotary axial direction "q" of the cam plate 104, and a spring 108 for urging the locking members 107 toward the cam 104, in which a lock pin 109 projecting from the locking member 107 is urged to be engaged with an engagement concave portion 110 formed at the periphery of the cam plate 104 so as to fix the cam plate 104 at the initial position.

Each locking member 107 includes a cam slant 111 directed to the key insertion opening 102 for lock release. As shown in FIG. 33, a point of the key 103 inserted in the key insertion opening 102 pushes the lock release cam slant 111 of each locking member 107 so as to move each locking member 107 backward against the spring 108 to release the locking for rotating the cam plate 104 by the subsequent insertion operation of the key 103

According to the conventional rotation lock mechanism 106 of the above-mentioned construction, the locking member 107 is disposed for a forward-and-backward movement in a rotary axial direction "q" of the cam plate 104, so that the arrangement space of the locking member 107 and the lock push spring 108 is large in the rotation axial direction "q" of the cam plate 104, so that the thickness of the whole switch in the forward and backward direction is bulky.

A pair of locking members 107 have to be disposed in front and back of the cam plate 104 to comply with the standard, whereby the space in the forward-and-backward direction of rotation lock mechanism 106 is enlarged causing a bulky key switch.

SUMMARY OF THE INVENTION

It is, therefore, a primary object of this invention to provide a thinner switch body an improved rotation lock mechanism.

According to a first aspect of this invention, there is provided a key switch including a cam member rotating in accordance with the insertion-and-pull of a key to be inserted into a key insertion opening, a plunger coming into contact with the circumferential cam side of the cam member, a switch mechanism actuated by the plunger which is displaced in accordance with the rotation of the cam member, and a rotation lock mechanism for locking the rotation of the cam member when the key is pulled, the rotation lock mechanism including a locking member which can be displaced in the direction parallel with a vertical rotation face on the rotation axis of the cam member and a spring urging the locking member toward a position to be engaged with the cam member, and the locking member being disposed to be displaced to a lock release position by contacting the key resisting the spring.

The rotation face is not limited to a surface of the rotating cam member, but includes a virtual rotation face of the interior which run through the cam member if it is perpendicular to a rotation axis of the cam member.

As the key is inserted into the key insertion opening, the key comes into contact with the locking member, and the locking member is displaced backward into the lack release position against the spring in the direction in parallel with a vertical rotation face on the rotation axis of the cam member. As the key is further inserted, the cam member is rotated in a predetermined direction and the plunger is displaced to switch contacts of the switch mechanism. The locking member is displaced in the direction parallel with the rotation face of the cam member, and not displaced in the rotational axis of the cam plate, that is, the forward-and-backward direction of the switch, so that the space for the lock mechanism in the forward and backward direction may be limited to a small space for accommodating the locking member, whereby the width of the whole configuration of the switch can be reduced.

According to a second aspect of this invention, there is provided a key switch including a cam member rotating in accordance with the insertion-and-pull of a key to be inserted into a key insertion opening, a plunger coming into contact with a circumferential cam side of the cam member, a switch mechanism actuated by the plunger which is displaced in accordance with the rotation of the cam member, and a rotational lock mechanism for locking the rotation of the cam member when the key is pulled, the rotational lock mechanism including a locking member which can be displaced in the direction parallel with a vertical rotation face in the rotational axis of the cam member, an intermediate operating member which comes into contact with the locking member for moving the same, and a spring urging the locking member toward a position to be engaged with the cam member, and the locking member being disposed to be displaced to a lock release position resisting the spring by displacing the intermediate operating member by the insertion of the key.

As the key is inserted into the key insertion opening, the key first comes into contact with the intermediate operating member and the locking member to displace the same, the locking member is touched and actuated by the intermediate operating member to be displaced backward into the lock release position against the spring in the direction parallel with a vertical rotation face in the rotational axis of the cam member. As the key is further inserted, the cam member is rotated in a predetermined direction and the plunger is displaced to switch contacts of the switch mechanism. The locking member is displaced in the direction parallel with the rotation face of the cam member, and not displayed in the rotational axis of the cam plate, that is, the forward-and-back ward direction of the switch, so that the space for the lock mechanism in the forward and backward direction may be limited to the space for accommodating the locking member.

The locking member is adapted not to be displaced in the rotational axis of the cam plate, whereby the space for the lock mechanism in the forward and backward direction may be reduced to a small space for accommodating the locking member, whereby the width of the whole configuration of the switch can be reduced. The locking member is not directly actuated by the key, but is indirectly actuated through the intermediate operating member, whereby the setting position of the locking member may be freely selected as to the key insertion position, and the cam member may be locked in the best position.

According to a third aspect of this invention, there is provided a key switch in the second aspect of this invention, in which the intermediate operating member is supported together with the cam member, and the intermediate operating member rotates together with the cam member in accordance with the rotation of the cam member after the lock release and includes a circular arc cam side for forcing the locking member into the lock release position.

As the cam member is rotated by the subsequent key insertion after the locking member is displaced backward into the lock release position through the intermediate operating member by the initial key insertion, the cam member rotates together with the intermediate operating member so that the circular arc cam side may force the locking member into the lock release position.

The lock release position of the locking member is retained by using the intermediate operating member. Accordingly, that the locking member unintentionally returning to the lock position can be avoided by a shifting movement of the key on its insertion and the key cannot be pulled out.

According to a fourth aspect of this invention, there is provided a key switch in one of the first to third aspects of this invention, in which the locking member includes a pair of locking members located forward and backward to hold forward and backward side surfaces, each of the locking members includes a lock pin projecting to a side surface of the cam member, and both side surfaces of the cam member are provided with engagement means actuated by the lock pins.

The lock pins of the pair of forward and backward locking members act on the forward and backward side surfaces of the cam member to uniformly apply the locking to the front and back of the cam member. Unless both locking members are moved to the lock release position, the cam member cannot be operated. Moreover, the engagement means acts on the lock pins of the locking members are disposed on side surfaces of the cam member, it may be optionally set without any relation to the configuration of the peripheral cam surface of the cam plate.

The front and back side walls of the cam plate are uniformly applied by locking, thereby ensuring the rotation locking, preventing the locking from being release by the operation of one of the locking members, and providing a highly reliable locking mechanism. The engagement means actuating the lock pin of the locking member may be optionally set independent from the shape of the external cam surface of the cam plate, the limitation of constructing the rotational lock mechanism is reduced, which is an advantageous designing.

According to a fifth aspect of this invention, there is provided a key switch in one of the first to fourth aspects of this invention, which further includes a support member axially supporting the cam member, in which the support member supports the locking member and the lock urging spring.

The support member may be assembled not only with the cam member but also with the locking member and the lock urging spring beforehand. Accordingly, the assembling work is improved in comparison with the assembly in which each component is brought and assembled into the switch housing.

According to a sixth aspect of this invention, there is provided a key switch in the fifth aspect of this invention, in which the support member includes an axial support wall for axially supporting the cam member, an external side surface of the axial support wall is provided with a concave portion to be engaged by the locking member and the spring member, and the locking member is engaged with the concave portion for a displacement movement.

The locking member and the spring may be assembled to the concave portion formed on the external side surface of the axial support wall with a direct visual inspection, and stable in the displacement within the concave portion.

When the locking member and the spring urging lock are assembled beforehand to the axial support wall of the support member, the assembly parts may be assembled to the external side surface of the axial support member with a direct visual inspection, whereby proper assembly may be made quickly. Moreover, the parts are assembled to the concave portion of the axial support wall, whereby the locking member and the spring are free from drop and positional shift, resulting in an improvement of operation and assembling work. The locking member may be stably displaced by guide of the concave portion of the axial support wall.

According to a seventh aspect of this invention, there is provided a key switch in one of the first to six aspects of this invention, which further includes a switch housing including a body housing enclosing the switch mechanism and the plunger and a head housing having the key insertion opening for enclosing the cam member and the rotational lock mechanism which is removably connected with the an upper end of the body housing.

The assembling work of the cam member and the rotational lock mechanism into the head housing may be separated from the assembling work of the switch mechanism and the plunger into the body housing so that the final assembly may be completed by connecting the previously assembled head housing with the upper end of the body housing. A thin key switch having good functioning is manufactured at a high efficiency.

According to an eighth aspect of this invention, there is provided a key switch in the seventh aspect of this invention, in which the key insertion opening is disposed on a side wall and an upper wall of the head housing, and the plunger projecting into the head housing from the center of the upper wall of the body housing is actuated by the cam member.

The head housing may be connected with the body housing by selecting the position of the key insertion opening in a right hand direction or in a left hand direction, thereby assembling a key switch with a left or right different actuating specification. Thus, the key switch with two specifications may be manufactured at a high assembling work, good efficiency, and a reduced cost.

According to a ninth aspect of this invention, there is provided a key switch in the eighth aspect of this invention, in which a pair of first connection portions are point-symmetrically disposed at corners corresponding to diagonal positions of the upper wall of the body housing, second connection portions are disposed at corners corresponding to diagonal positions of a lower wall of the head housing to be engaged with the first connection portions, and engaged the first and second pairs of connection portions are pierced and tightened by screws.

When the head housing is connected with the body housing by positioning the key insertion opening in a left or right direction, the two pairs of point-symmetrically located connection portions are engaged and screwed one after another, whereby a key switch having different specifications of left and right directions may be assembled by the operation at the pair of screws.

Thus, the connecting steps and the number of parts is reduced, resulting in a cost reduction.

According to a tenth aspect of this invention, there is provided a key switch in one of the first to ninth aspects of this invention, in which the body housing at a lower end thereof has an opening, and is successively inserted by an inelastic member, a seal member of an elastic material, a bottom cover of inelastic material after the switch mechanism is inserted into the body housing, and the body housing is mounted by a support member piercing the inelastic member and the bottom cover, and the support member allows the inelastic member and the bottom cover to press the seal member and be supported to the body housing.

The sealing is performed by the sealing member, whereby any troublesome plastic sealing is not required. Accordingly, productivity increases and cost reduction may be found.

BRIEF DESCRIPTION OF THE DRAWINGS

Other objectives and advantages of this invention will be more readily apparent from the following detailed description provided in conjunction with the following figures, of which.

DETAILED DESCRIPTION OF THE PREFERRED EMBODIMENTS (First Embodiment)

Figure 1:
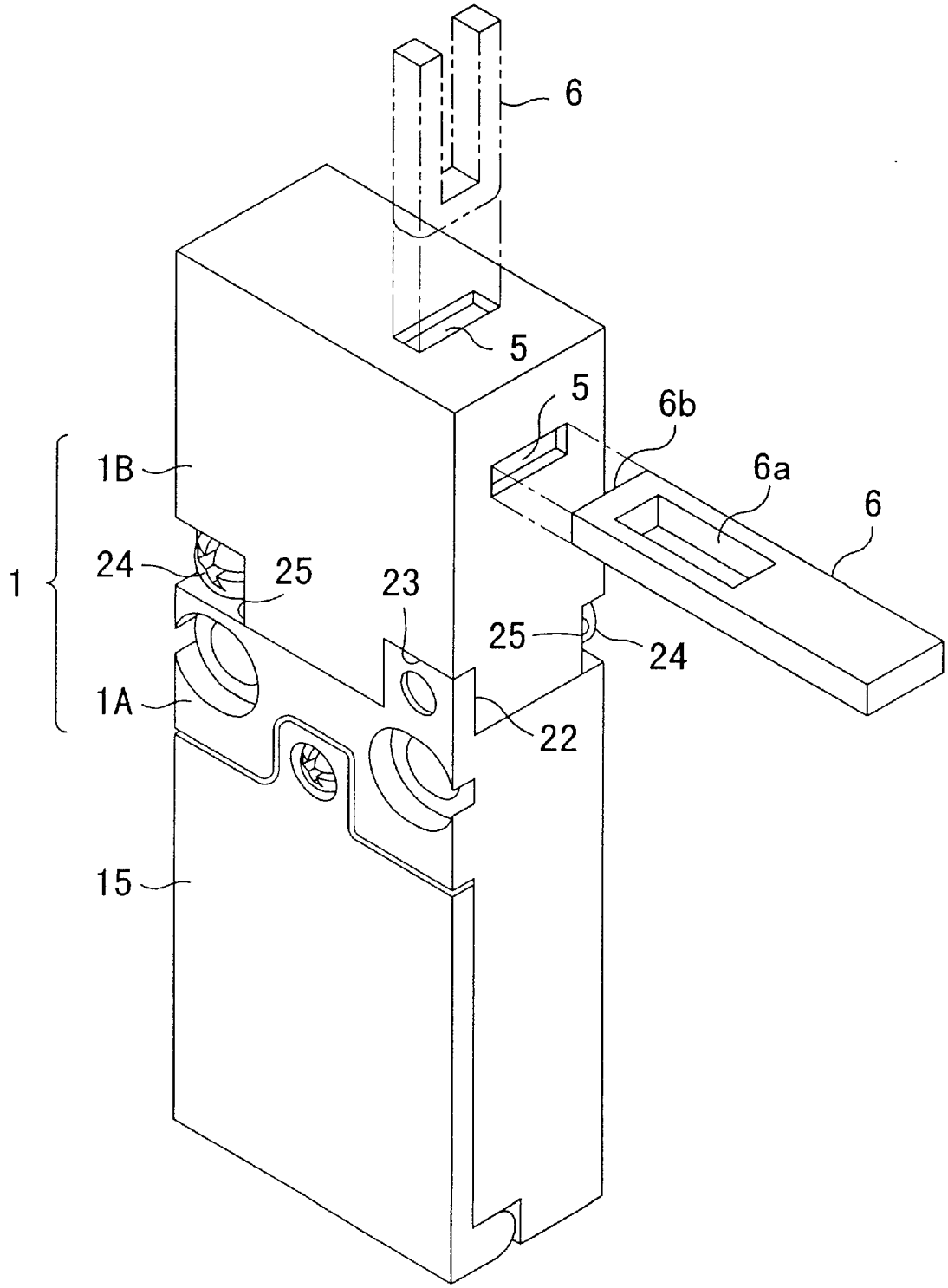
FIG. 1 is a perspective external view of a key switch according to a first embodiment of this invention.
Figure 2:
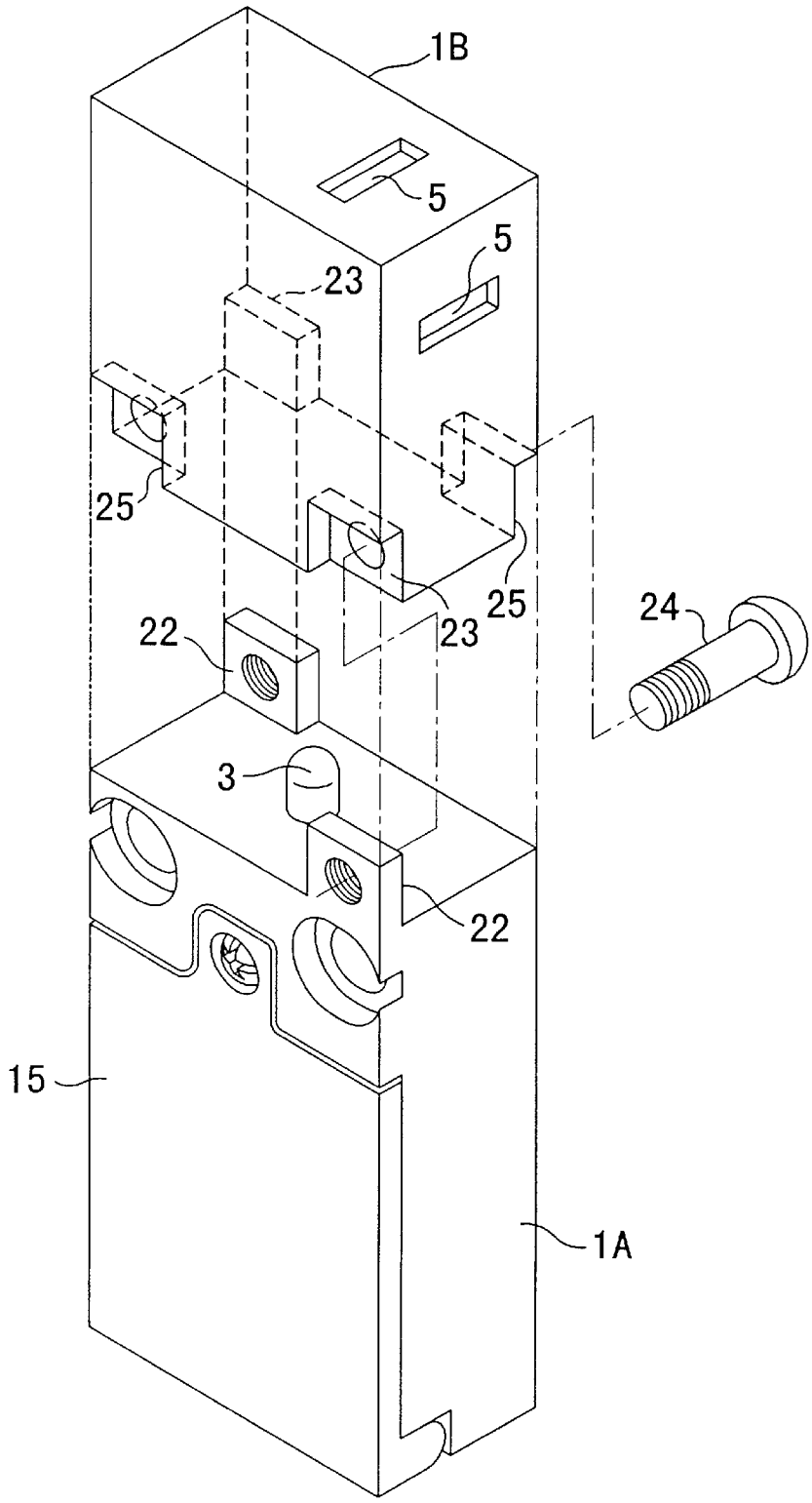
FIG. 2 is a perspective disassembled view of the key switch of FIG. 1.

Returning to FIGS. 1 to 12, there is shown a key switch according to a first embodiment of this invention. FIG. 1 shows an external perspective whole view of the key switch, FIG. 2 shows a perspective disassembled view of the key switch, and FIG. 3 shows a vertically sectional front view of the key switch of FIG. 1.

A housing 1 of this key switch consists of a body housing 1A and a head housing 1B connected with an upper end of the housing 1A. The body housing 1A accommodates a switch mechanism 2 and a plunger 3 switching the same, and the head housing 1B rotatably accommodates a cam plate 4 around a central axis "p" in a forward-and-backward direction as a cam member. The switching operation of contacts of the switch mechanism 2 is designed to be switched by the insertion and pull-out action of a key 6 applied to one of two key insertion openings 5 disposed on a side wall and the upper wall of the head housing 1B and its subsequent vertical movement of the plunger 3 following a peripheral cam surface of the cam plate 4 rotated by the key 6.

Figure 3:
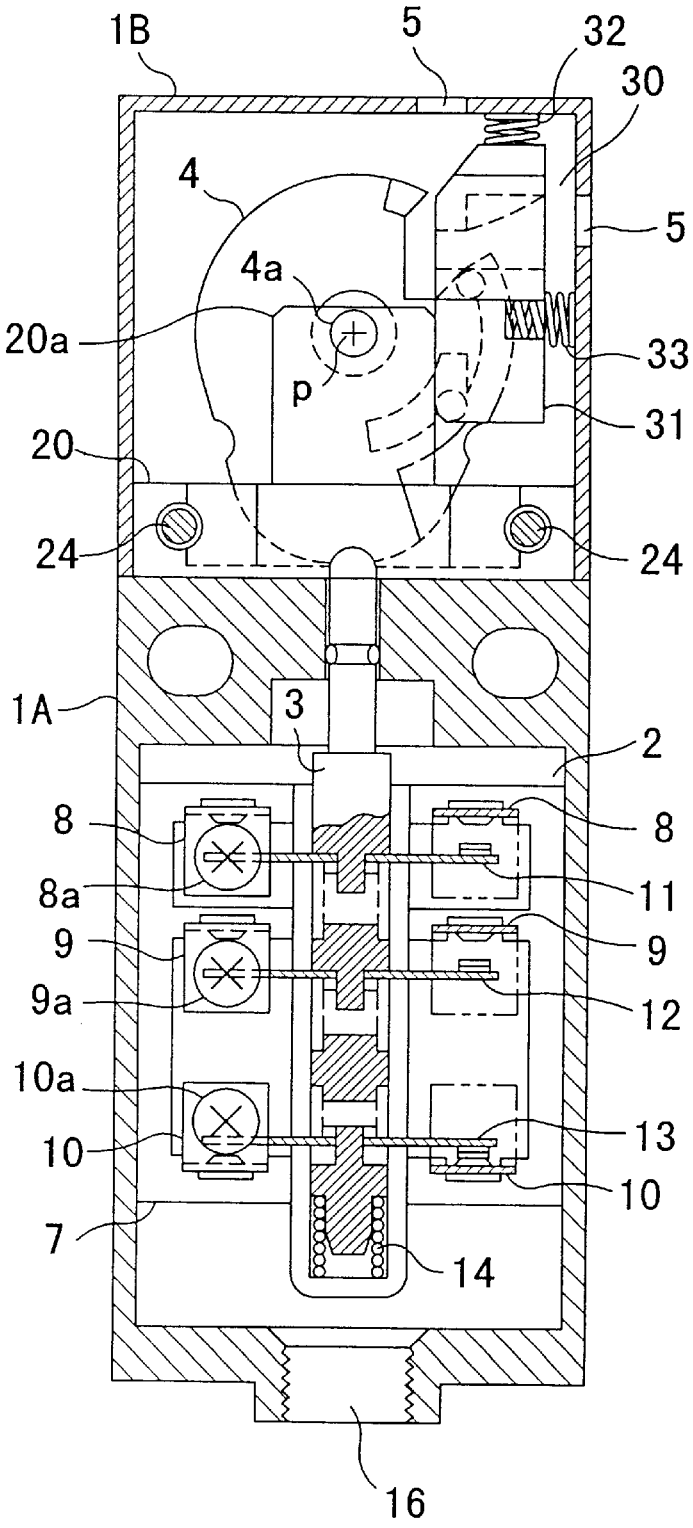
FIG. 3 is a vertically sectional front view of the key switch of FIG. 1.

As shown in FIG. 3, a holder provided with the switch mechanism 2 is installed within the body housing 1A, and the plunger 3 is supported to allow a vertical and slidable movement to project and withdraw from the center of the upper wall of the body housing 1A. The switch mechanism 2 includes three pairs of stationary terminals 8, 9 and 10 mounted by terminal screws 8*a*, 9*a* and 10*a* for external wiring, and three pairs of movable terminals 11, 12 and 13. In the initial position where the key 6 is pulled out from the switch, the plunger 3 is displaced down against a compression spring 14 as shown in FIG. 3 wherein the movable terminals 11 and 12 are separated from the stationary terminals 8 and 9 to break their respective connection with the terminals 8 and 9 and the movable terminal 13 comes into contact with the stationary terminal 10 to make a conduction therewith. In this embodiment, the stationary terminals 8 and 9 are used as normal open terminals, and the stationary terminal 10 is used as a normal closed terminal. A front cover 15 is disposed on the front face of the body housing 1A to be swung closed and open, turning a bottom end of the cover into its supporting point. On a bottom wall of the body housing 1A there is disposed a wiring opening 16 through which lead wires are inserted within the housing to be connected with the stationary terminals 8, 9 and 10 by screws.

The screw connection in this embodiment may be modified to employ a pre-wiring method, if desired.

Figure 4:
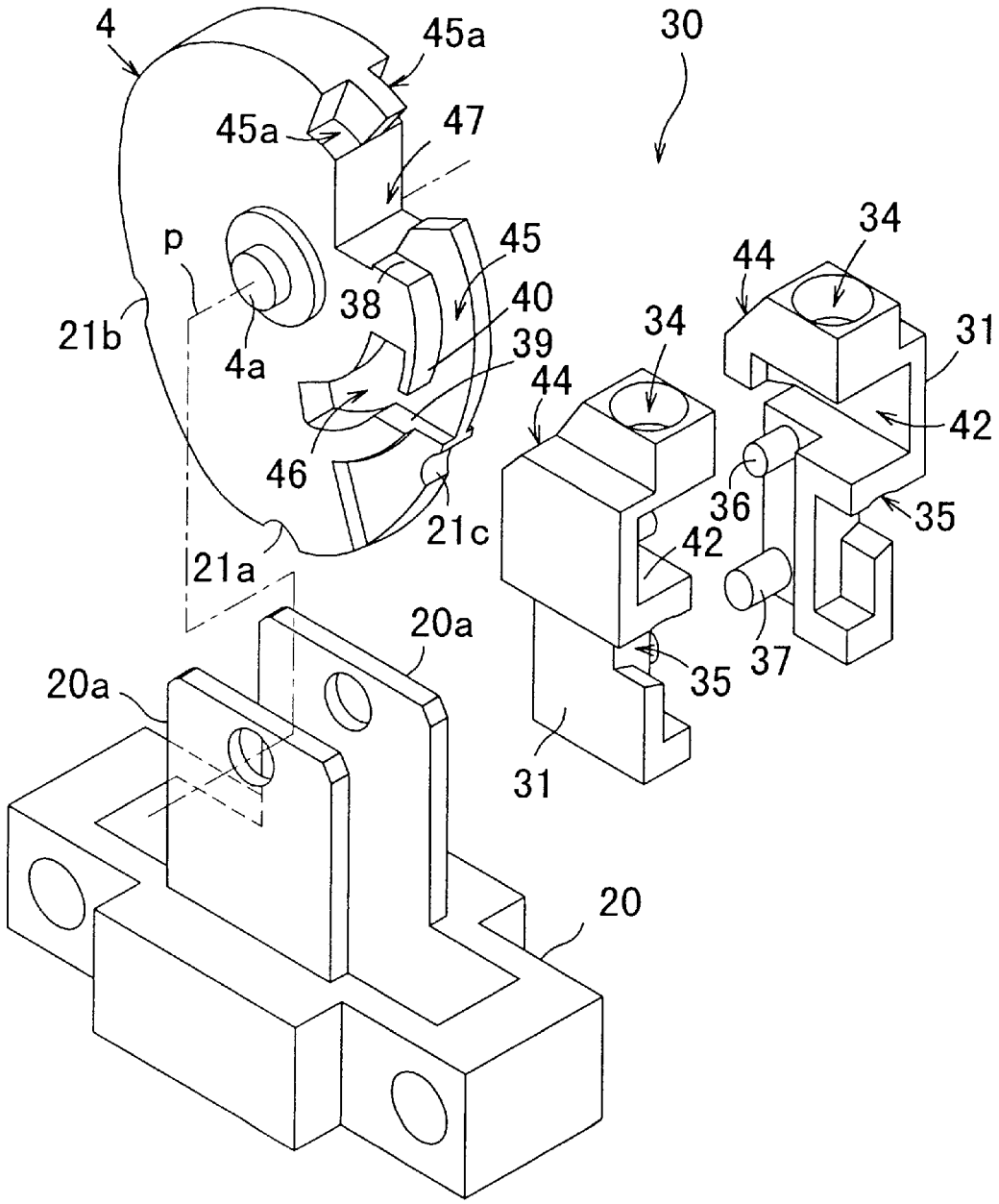
FIG. 4 is a perspective disassembled view of a cam plate and a rotation lock mechanism employed in the key switch of FIG. 3.
Figure 5:
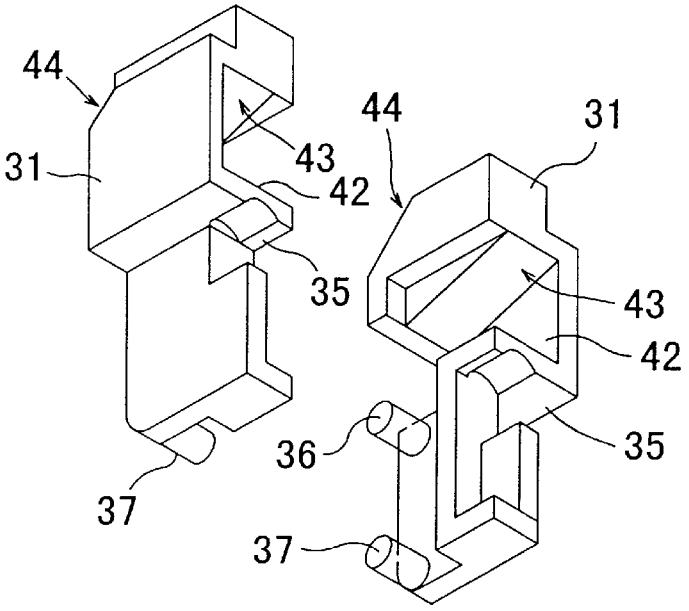
FIG. 5 is a bottom perspective view of the rotation lock mechanism of FIG. 4.

As shown in FIGS. 3 and 4, a fulcrum bracket 20 is mounted within the head housing 1B as the support member, and a pair of front and back axial support walls 20*a* standing on the fulcrum bracket 20 are engaged by a rotational axis 4*a* protruding from the front and back side walls of the cam plate 4 so that the cam plate 4 may be supported for a rotary movement around the central axis "p" directed between front and back centers of the left and right walls of the head housing 1B. The cam plate 4 at its peripheral surface has a cam surface followed by the top end of the plunger 3, and further includes three concave portions 21*a*, 21*b* and 21*c* at three points in a peripheral direction to be stably engaged by the top end of the plunger 3 for detainment.

Figure 8:
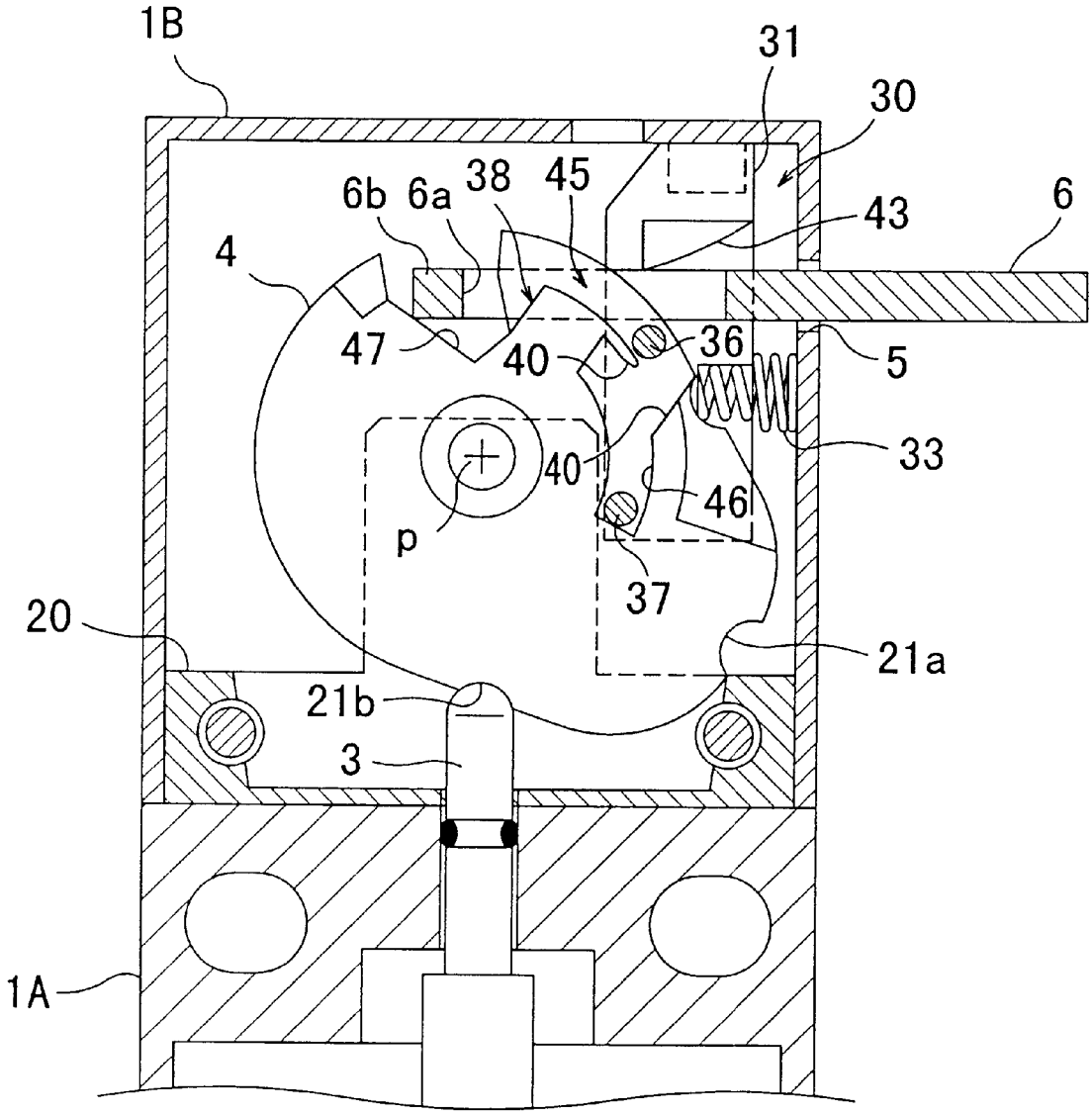
FIG. 8 is a vertically sectional front partial view of a major portion of the key switch of FIG. 3 after completing the key insertion.
Figure 11:
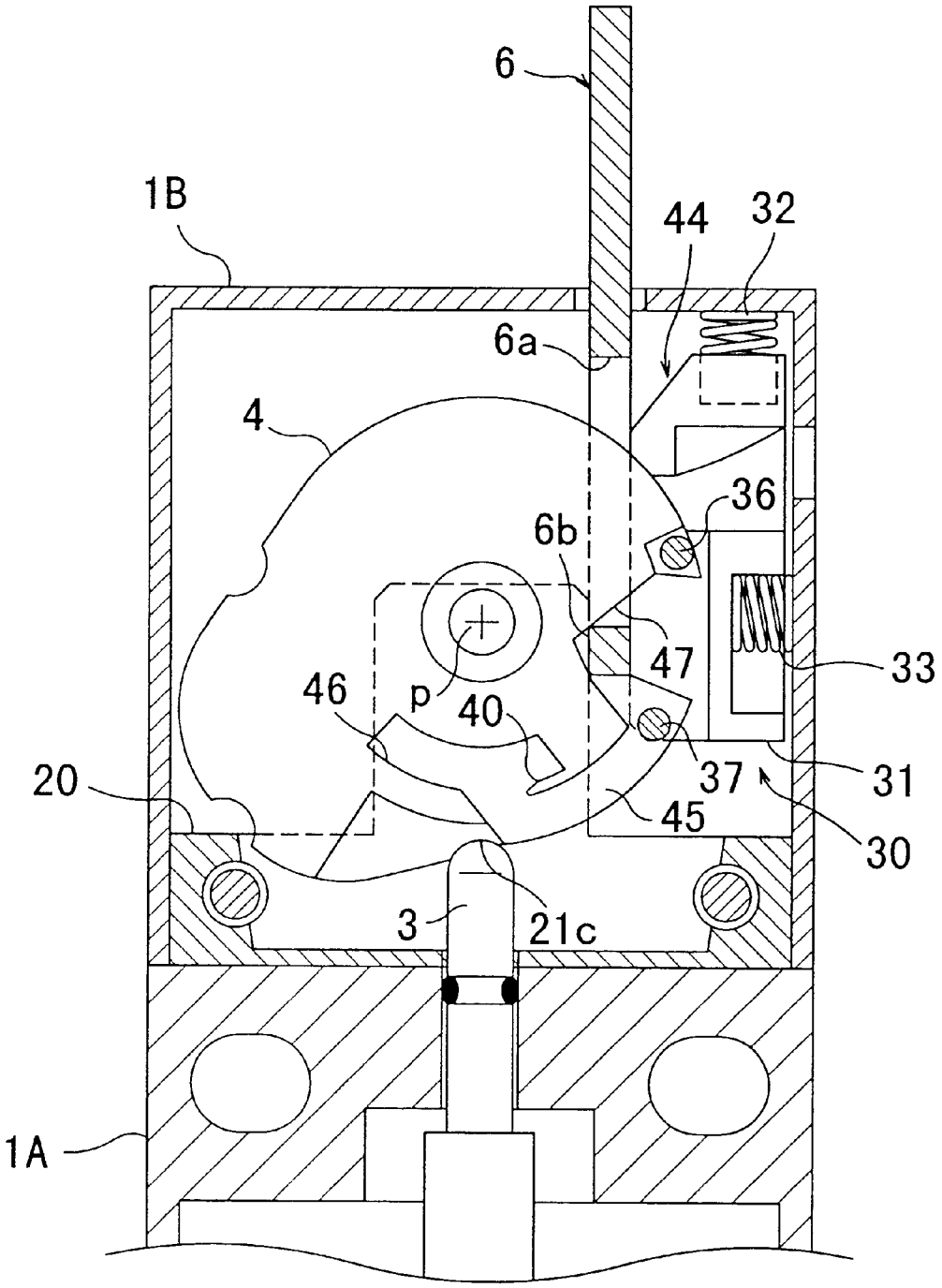
FIG. 11 is a vertically sectional front partial view of the major portion of the key switch of FIG. 10 after completing the key insertion.

In the initial position where the key 6 is pulled out, the concave portion 21*a* having the largest diameter for detainment is stably engaged by the top end of the plunger 3. Referring to FIG. 8, as the key 6 is inserted through the key insertion 5 on the side wall, the cam plate 4 is rotated counterclockwise so that the top end of the plunger 3 is relatively moved toward a small diameter side of the peripheral cam surface of the cam plate 4 and stably engaged with other concave portion 21*b* having a small diameter for detention, whereby the plunger 3 is moved upward by the compression spring 14 to switch the switch mechanism 2. Referring to FIG. 11, as the key 6 is inserted through the key insertion opening on the upper wall of the head housing 1B, the cam plate 4 is rotated clockwise in FIG. 11 so that the top end of the plunger 3 is relatively moved toward a small diameter side of the peripheral surface of the cam plate 4 and stably engaged with the concave portion 21*c* having a small diameter for detainment, whereby the plunger 3 is moved upward by the compression spring 14 to switch the switch mechanism 2.

Thus the constructed head housing 1B is designed to be capable of being connected with the body housing 1A by changing the operation direction from right and left or from left to right to set the key insertion opening 5 to either one of the left and right horizontal directions. As shown in FIGS. 1 and 2, there are disposed a pair of connection portions 22 projecting from a corner at right hand front side on the upper wall of the body housing 1A and from a corner symmetrically located at left hand rear side on the upper wall. At the bottom end of the head housing 1B, there are disposed a pair of rectangularly recessed connection portions 23 at a corner of a right hand front side and at a corner of a left hand rear side corner. The respective pairs of connections 22 and 23 are engaged and pierced by screws 24 to screw to the connection portions 22 of the body housing 1A, thereby screwing and fixing the head housing 1B to the body housing 1A. In this embodiment, there are disposed a pair of recessed portions 25 at other corners of the bottom end of the head housing 1B to accommodate heads of the screws 24.

According to the above-mentioned construction, the head housing 1B turned from left to right may be screwed by engagement between the connection portions 22 and 23 in the same way, whereby there may be provided the key switch having the key insertion opening 5 formed on the left hand side wall and the upper wall. The plunger 3 is located at the center of the upper wall of the body housing 1A, and the central axis "p" of the cam plate 4 is located in right and left core, whereby the cam plate 4 correctly actuates the top end of the plunger 3 even if the head housing 1B is inverted left-and-right and connected with the body housing. The two inserted screws 24 pierce left and right portions of the fulcrum bracket 20 mounted in the head housing 1B, thereby firmly screwing the bracket 20 within the housing 1B.

Thus, the fulcrum bracket 20 supporting the cam plate 4 is also screwed and fixed by the two screws 24 connecting the head housing 1B with the body housing 1A, whereby any exclusive member nor assembling process for fixing the bracket 20 are not necessary, resulting into the improvement of the productivity and the cost reduction of manufacturing. If desired, the bracket 20 may be combination of two separated members having the same configuration, instead of the single unit of this embodiment.

As shown in FIGS. 3 to 6, thus constructed key switch further includes a rotation lock mechanism 30 within the head housing 1B to disable the rotation of the cam plate 4 at the initial position in order to avoid the rotation of the cam plate 4 by the insertion into the key insertion opening 5 at the initial position where the key 6 is pulled out.

The rotation lock mechanism 30 is provided with a pair of front and back locking members 31 to act on the front and back side walls of the cam plate 4. The locking members 31 are disposed to hold the cam plate 4 from the front and the back, and supported within the housing for horizontal and vertical movement of the plane perpendicular to the rotational axis 4*a* of the cam plate 4. The movement direction of the locking member 31 is not limited to the vertical direction and the left-and-right direction, but may be a slant direction in parallel with the rotation face perpendicular to the rotational axis 4*a* of the cam plate 4 if desired. The rotation face may be an internal virtual rotation face crossing the cam plate 4.

A compression spring 32 is interposed between each locking member 31 and an internal face 1*u* of the upper wall of the housing 1B to push each locking member 31 toward the cam plate 4 in the lock position, and a compression spring 33 is also interposed between each locking member 31 and an internal face 1*s* of the side wall of the housing 1B to push each locking member 31 toward the cam plate 4 in the lock position. The spring 32 is held by a spring receipt concave portion 34 to move together with each locking member 31 in a left and right direction, and the spring 33 is also held by a spring receipt concave portion 35 to move together with each locking member 31 in a vertical direction.

Figure 6:
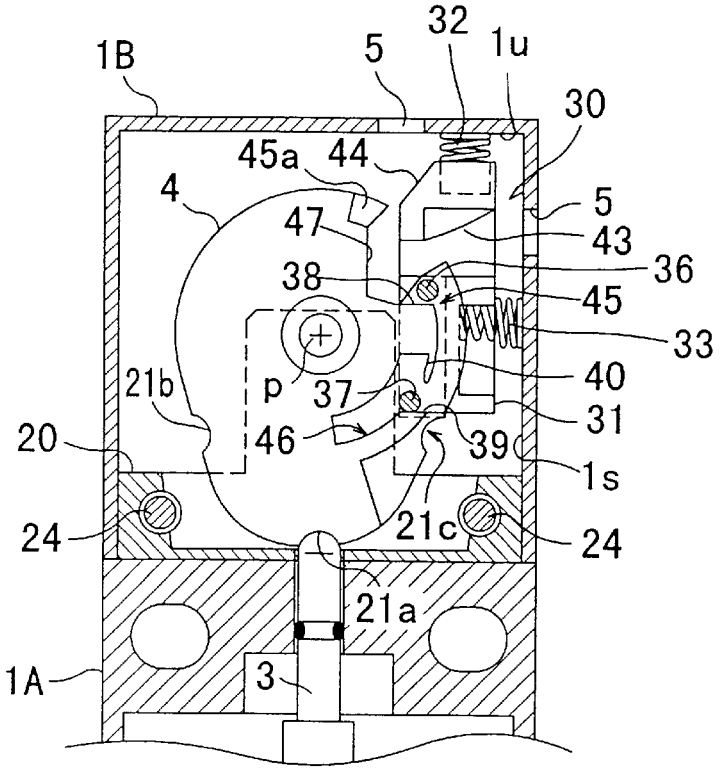
FIG. 6 is a vertically sectional front partial view of a major portion of the key switch of FIG. 3 in an initial position.

On the opposing wall of each locking member 31 a pair of lock pins 36 and 37 are projected across the rotation central axis "p" of the cam plate 4. As shown in FIG. 6, in the initial position where the key 6 is pulled out, the respective lock pins 36 and 37, pressed by the springs but retained into the locked position, oppose and come into contact with steps 38 and 39 formed on the front and back side walls of the cam plate 4. Accordingly, even if a screw driver or the like is inserted into the key insertion opening 5 of the right hand side wall to rotate the cam plate 4 counterclockwise, the counterclockwise rotation of the cam plate 4 is blocked by the steps 38 and 39 contacting with the lock pins 36 and 37. If the cam plate 4 is forced to be rotated counterclockwise, the locking member 31 is slightly displaced upwardly against the spring 33 but insufficient to release the steps 38 and 39 from the lock pins 36 and 37, wherein the cam plate 4 cannot have enough rotation to switch the switch mechanism 2

A projection 40 opposing to the lower lock pin 37 from the above is disposed on an upper position of the step 39, and the downward movement of the locking member 31 is blocked by a step 41 (see FIG. 9) formed on an inner surface of the housing. Accordingly, even if a screw driver or the like is inserted into the key insertion opening 5 to rotate the cam plate 4 confront clockwise, the further clockwise rotation of the cam plate 4 is blocked by the projection 40 in contact with the lock pin 37.

On opposing portions of both locking members 31 there are disposed concave grooves 42 for guiding in left-and-right direction the key 6 inserted through the key insertion opening 5 of the side wall. Lock release cam slant faces 43 are disposed on upper walls of the concave grooves 42 to move the locking members 31 upward against the spring 32 by contacting the inserted normal key 6. Lock release cam slant faces 44 are disposed on upper surfaces of both locking member 31 to move the locking members 31 horizontally against the spring 33 by contacting the key 6 inserted through the key insertion opening 5 of the upper wall. A circular arc concave portion 45 is formed from the outside in a radial direction of the upper step 38 to the lower step 39, and a circula arc concave groove 46 is formed on inner side in a radial direction of the lower step 39 and the projection 40.

A switch operation when the normal key 6 is inserted into the key insertion opening of the side wall or the upper wall of the housing will be described hereinafter.

Figure 7:
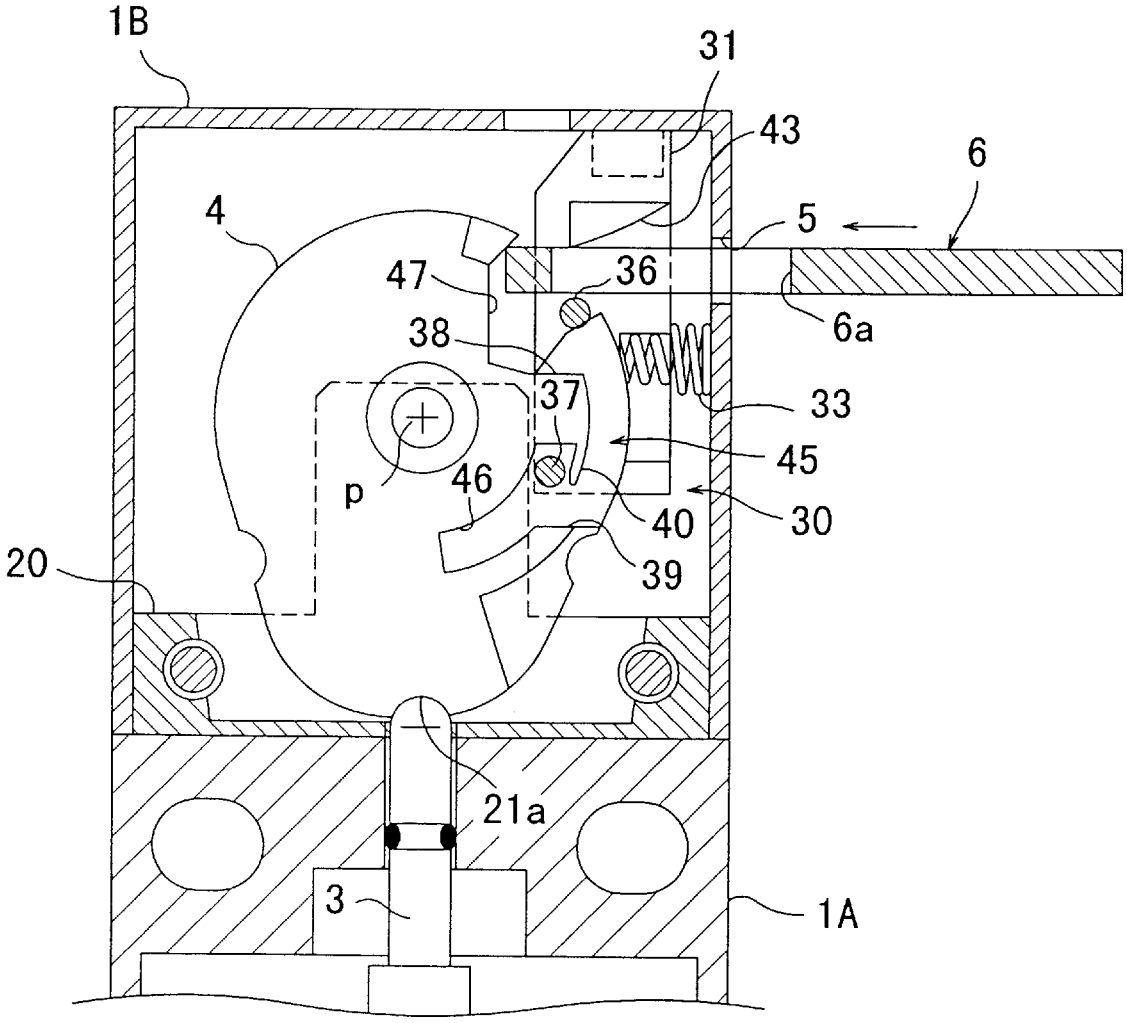
FIG. 7 is a vertically sectional front partial view of a major portion of the key switch of FIG. 3 in the initial position where a key is inserted into a key insertion opening of a side wall of the switch.

In FIG. 7, as the key 6 is inserted into the key insertion opening 5 of the side wall, the key 6 is first inserted through the concave grooves 42 of both locking members 31 to come into contact with the lock release cam slant faces 43, thereby moving the locking members 31 into the upper lock release position against the spring 33. Upon the upward displacement of the locking member 31, the upper lock pins 36 depart from the rotation center axis "p" of the cam plate toward an upper portion of the circular arc concave portion 45 but the lower lock pins 37 approach the rotation center axis "p" to pass through inner side of the projection 40 and to enter near an upper end of the circular arc concave groove 46. Thus, a lock release position is ensured wherein the engagement between both lock pins 36 and 37 and the steps 38 and 39 is released.

As the key 6 is subsequently further inserted, a top end of the key 6 presses the cam plate 4 to largely rotate the cam plate 4 counterclockwise as shown in FIG. 8. The locking pins 36 relatively move the lower portions of the circular arc concave portions 45, and the lock pins 37 relatively move the lower portions of the circular arc concave portions 46.

Figure 9:
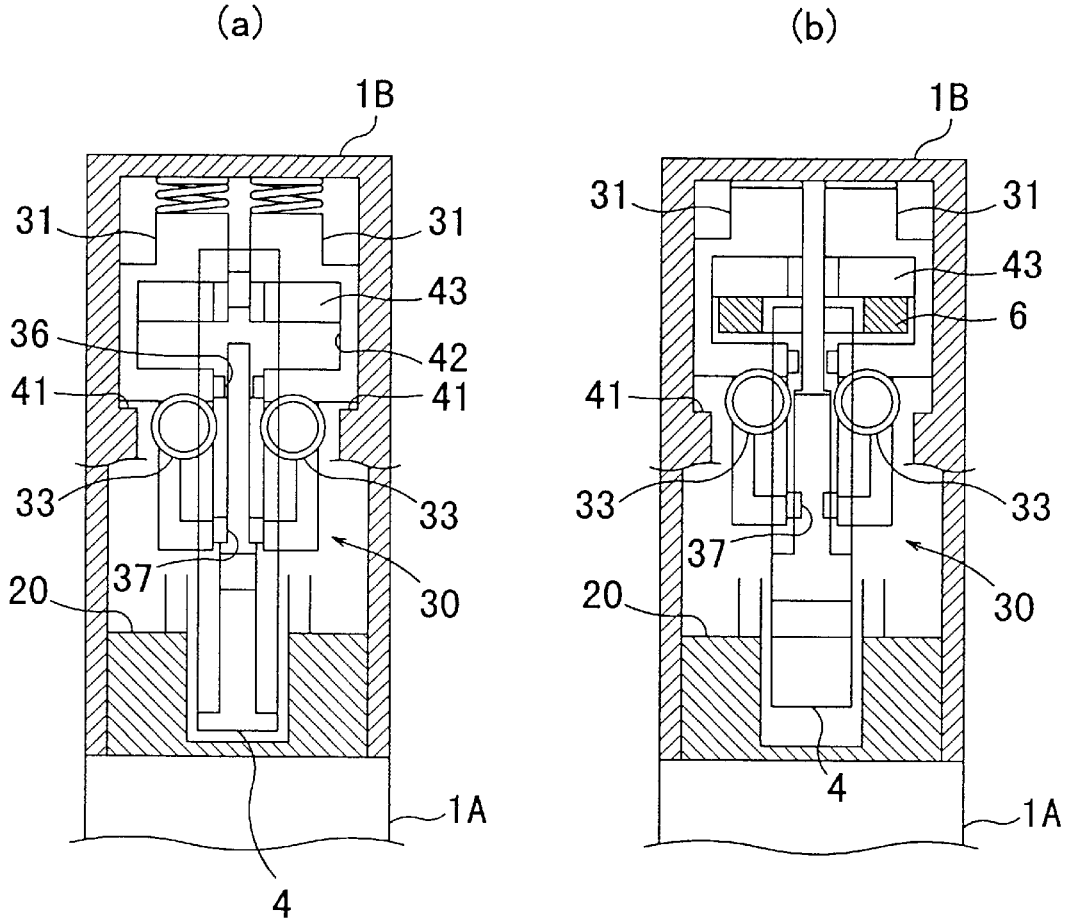
FIG. 9 at (a) shows a vertically sectional side partial view of the major portion of the key switch of FIG. 3 in the initial position, and FIG. 9 at (b) shows is a vertically sectional side partial view of the major portion of the key switch of FIG. 3 after completing the key insertion.

Thus, upon large counterclockwise rotation of the cam plate 4, the plunger 3 is released from the locking and reset to its original position to switch the contacts of the switch mechanism 2, whereby the upper end of the plunger 3 is stably engaged with the concave portion 21*b*. The key 6 of this embodiment is provided with an opening 6*a*. As shown in FIG. 8 and FIG. 9 at (b), in a switched position of the switch mechanism, a leading bridge portion 6*b* of the key 6 enters into the cut out concave 47 of the cam plate 4, so that the bridge portion 6*b* may hook and rotate the cam plate 4 in a clockwise direction as the key is pulled out and the operation returns to its original position.

Figure 10:
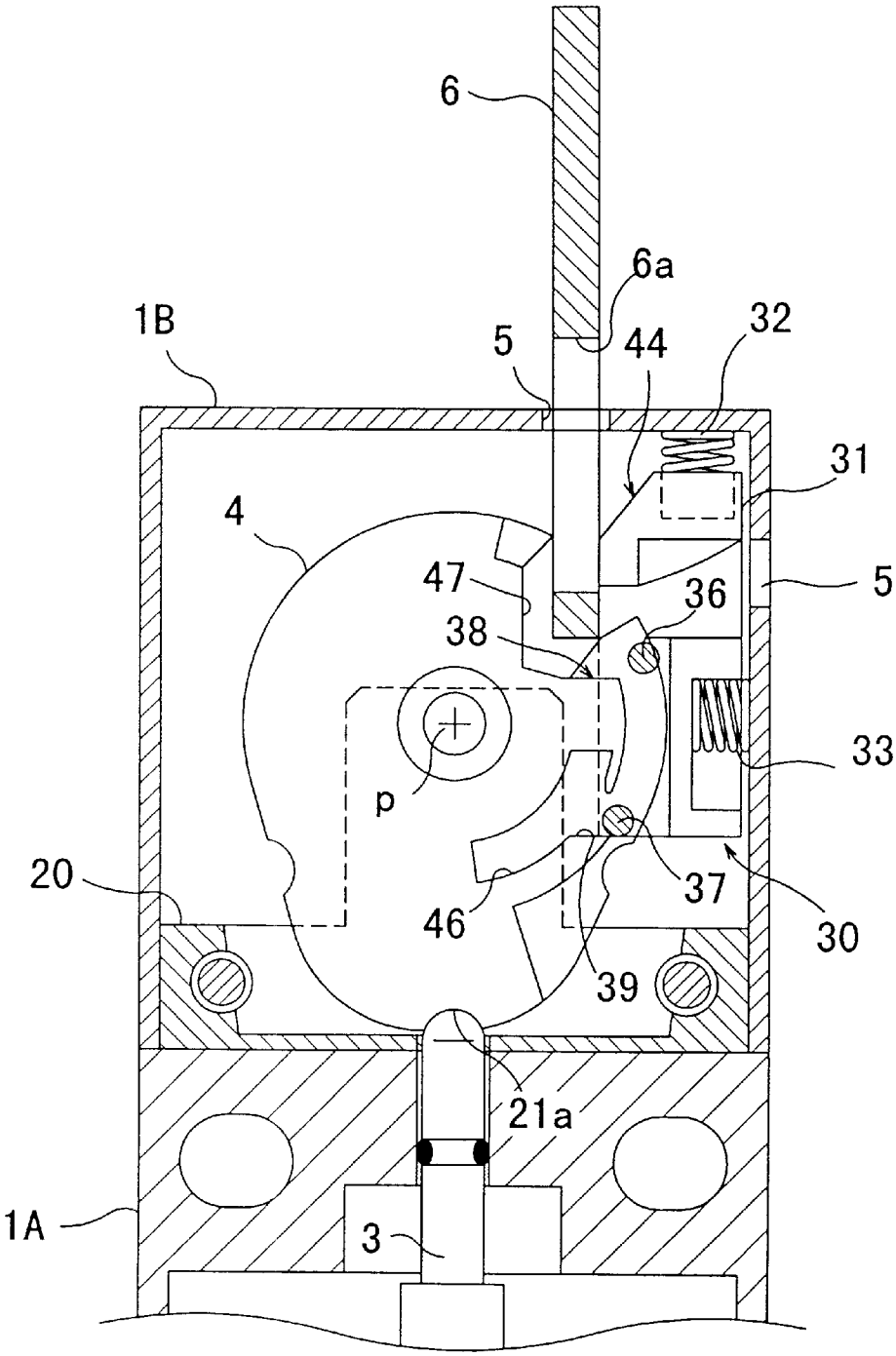
FIG. 10 is a vertically sectional front partial view of a major portion of the key switch of FIG. 3 in the initial position where a key is inserted from a key insertion opening disposed on a upper wall of the key switch.

As shown in FIG. 10, as the key 6 is inserted into the key insertion opening 5 of the upper wall, the key 6 first comes into contact with the lock release cam slant faces 44 of the both locking members 31, and the locking members 31 are moved to the lock release position in a side outward direction against the springs 33. By this side outward movement of the locking members 31, the upper lock pins 36 are disengaged from the step 38 to be moved above the circular arc concave portion 45 and the lower lock pins 36 are also outwardly disengaged from the projection 40 to be moved below the circular arc concave portion 45. Thus, both lock pins 36 and 37 rotate upwardly relative to the cam plate 4, whereby the lock release status is achieved.

Subsequently, as the key 6 is inserted, the tip of the key 6 pushes the cam plate 4 to rotate the same clockwise as shown in FIG. 11. Then, the lock pins 36 relatively move across the cut-out concave portion 47, and enter into the upper extended portions 45*a* of the circular arc concave portions 45 shown in FIG. 4. The lock pins 37 relatively move toward above the circular arc concave portions 45.

Figure 12:
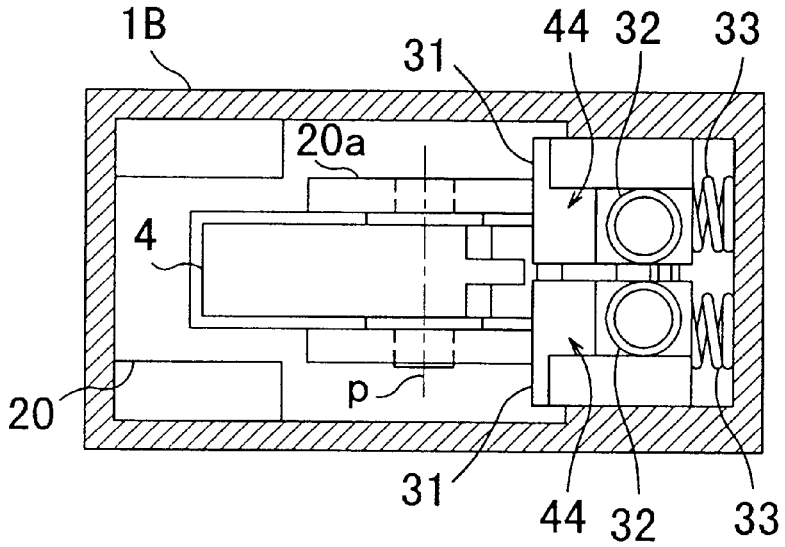
FIG. 12 at (a) shows a traverse plan view of a major portion of the key switch of FIG. 3 in the initial position, and FIG. 12 at (b) shows is a traverse plan view of the major portion of the key switch of FIG. 3 after completing the key insertion.
Figure 12:
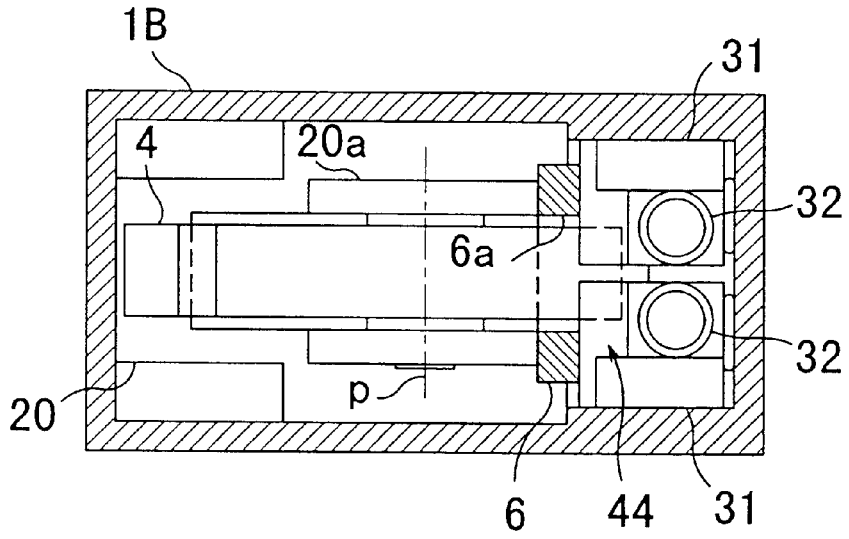
Figure 13:
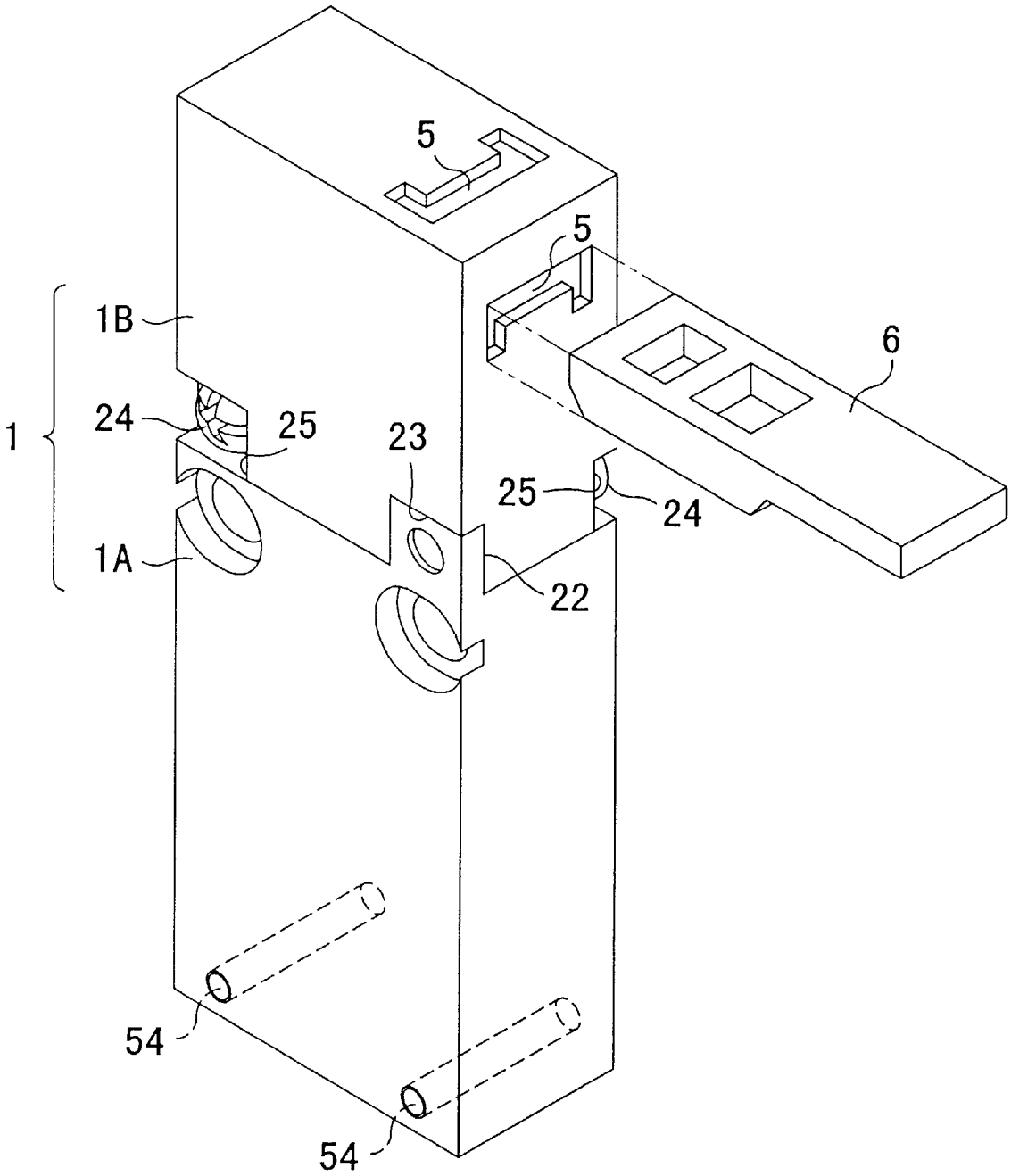
FIG. 13 is a perspective external view of a key switch according to a second embodiment of this invention.

Thus, upon large clockwise rotation of the cam plate 4, the plunger 3 is released from the locking and reset to its original position to switch the contacts of the switch mechanism 2, and the upper end of the plunger 3 is stably engaged with the concave portion 21*c* of the cam plate 4. As shown in FIG. 11 and FIG. 12 at (b), in this switched position of the switch mechanism, the leading bridge portion 6*b* of the key 6 enters into the cut out concave 47 of the cam plate 4, so that the bridge portion 6*b* may hook and rotate the cam plate 4 in a counterclockwise direction as the key is pulled out and the operation returns to its original position.

(Second Embodiment)

In FIGS. 13 to 22, there is shown a key switch as a second embodiment of this invention. The same parts and the same construction as those in the first embodiment are given the same reference symbols, and the detailed description will be omitted.

In the same way as that in the above-described first embodiment, a housing 1 of this key switch consists of a body housing 1A and a head housing 1B connected with an upper end of the housing 1A. The body housing 1A accommodates a switch mechanism 2 and a plunger 3 switching the same, and the head housing 1B accommodates the cam plate 4 rotation around a central axis "p" in a forward-and-backward direction as the cam member. The switching operation of contacts of the switch mechanism 2 is designed to be switched by the insertion and pull-out action of a key 6 applied to one of two key insertion openings 5 disposed on a side wall and an upper wall of the head housing 1B and its subsequent vertical movement of the plunger 3 following a peripheral cam surface of the cam plate 4 rotated by the key 6.

Figure 14:
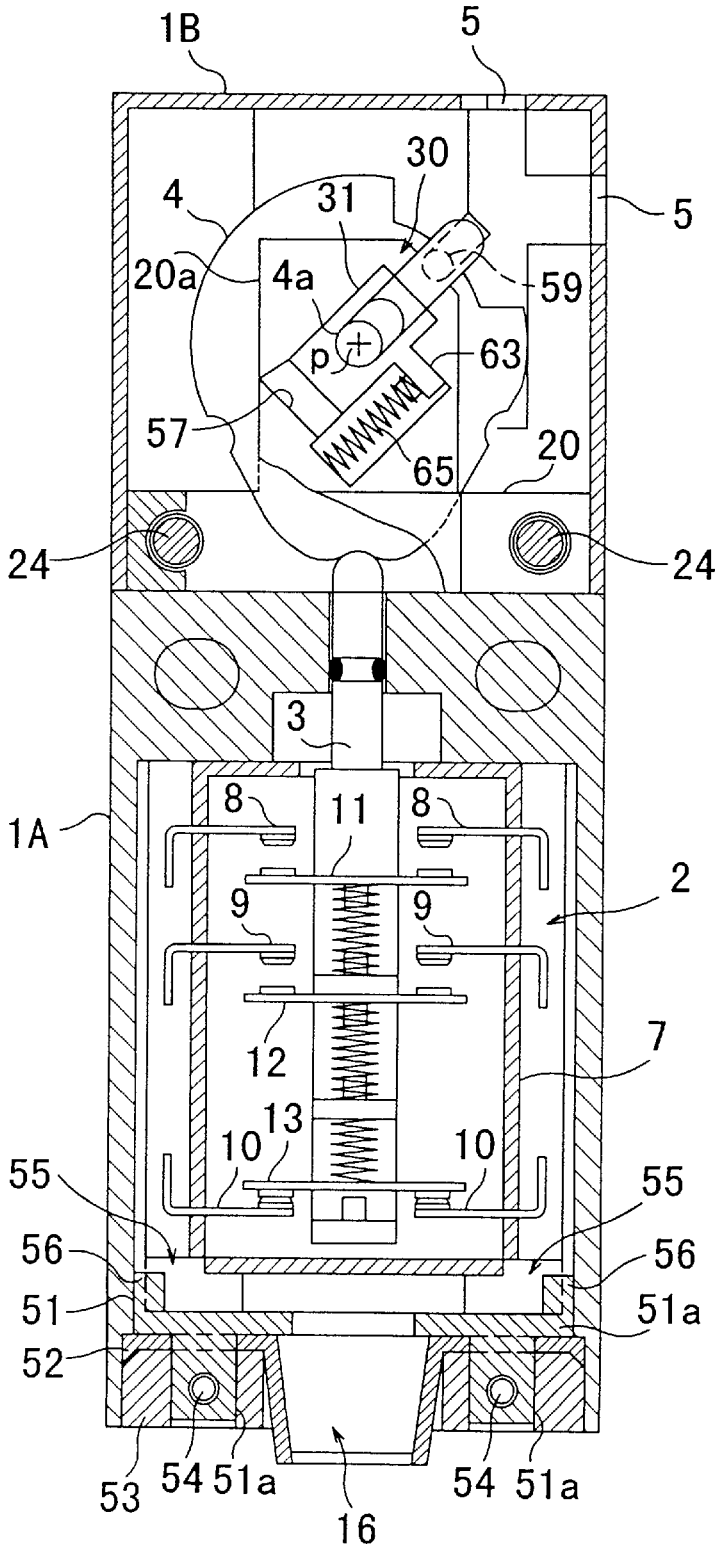
FIG. 14 is a vertically sectional front view of the key switch of FIG. 13.
Figure 15:
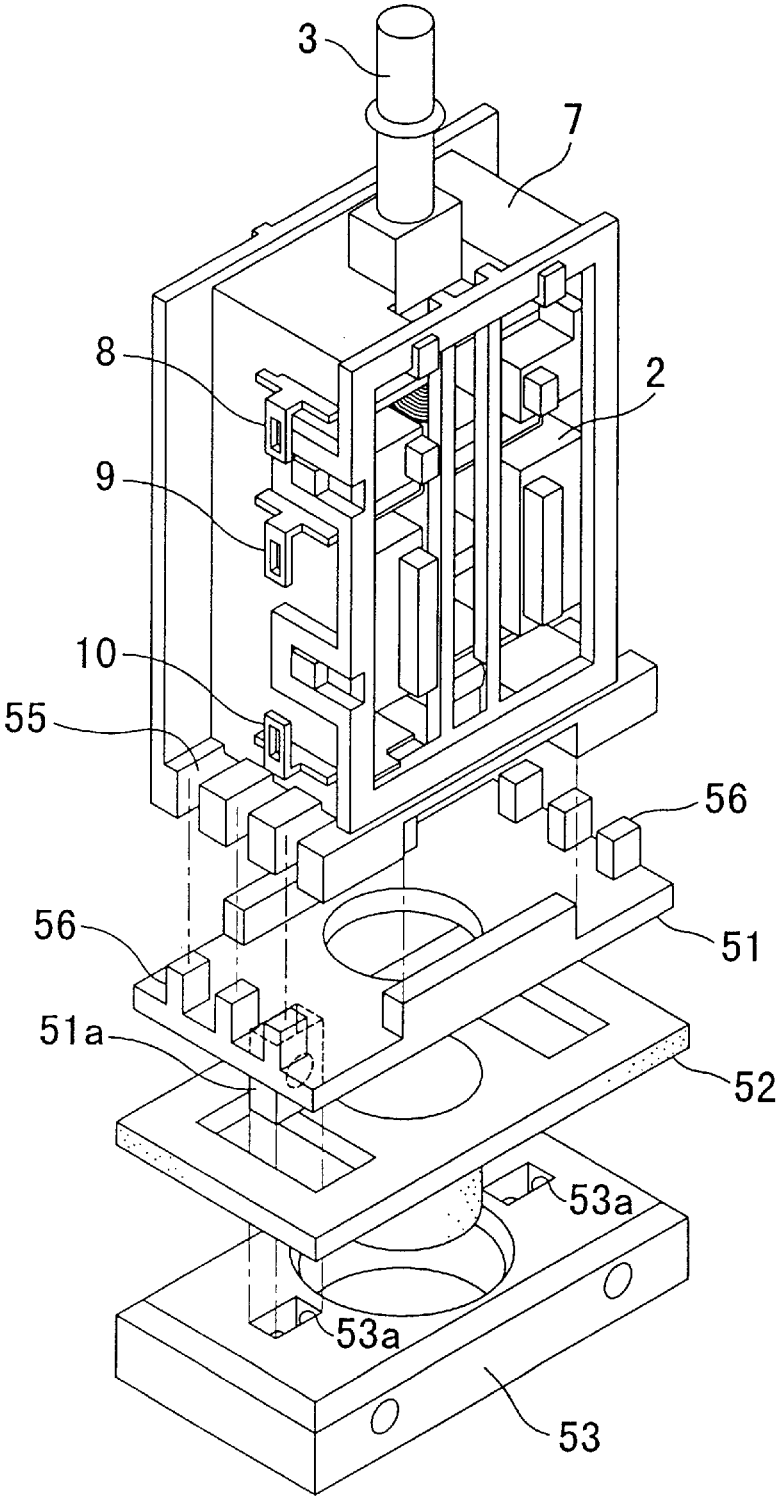
FIG. 15 is a perspective disassembled view as to a switch mechanism and its peripheral components in the key switch of FIG. 13.

As shown in FIG. 14, the body housing 1A of this embodiment is of a boxed shape at its lower end an opening, and inserted by a switch mechanism 2 equipped with a holder 7 shown in FIG. 15 through the opening of the housing. The housing is further inserted by non-elastic materials such as a seal plate 51 made of hard resin, elastic materials such as a rubber seal member 52, and non-elastic materials such as a bottom cover 53 made of hard resin, which are retained by a pair of left and right support pins 54 force-fitted into the lower end of the housing 1A.

The seal member 52 is held between the seal plate 51 and the bottom cover 53, a pair of left and right leg portions 51*a* projecting from a lower face of the seal plate 51 are inserted into openings 53*a* of the bottom cover 53 which are force-fitted by the support pins 54 made of hard resins or metals. That is, the seal plate 51 and the bottom cover 53 hold the seal member 52, and are inserted by the support pins 54 to be supported to the housing 1A. Thus, the holder 7 provided with the switch mechanism 2 is blocked from their displacement to a lower position by the rigidity support pins 54 and the seal plate 51 to be fixed to the body housing 1A. The fix and support may be done by screws instead of the pins, if desired.

Since the sealing in this embodiment is ensured by the seal member 52, any resin sealing is not necessary, whereby the productivity is improved and the manufacturing cost is reduced.

In the switch mechanism 2 of this embodiment, stationary terminals 8, 9 and 10 have projections at left and right sides of the holder 7 to be soldered with lead wires. In order to give out the connected lead wires through a wiring opening 16 without mutual interference or getting caught on the assembly, wire guide grooves 55 are provided on the left and right hand sides of the seal plate 51 and guide pieces 56 partially engage with the wire guide grooves 55, whereby the connected lead wires are aligned and smoothly pulled out through the wiring opening 16, resulting in an improvement of the assembling work.

Figure 16:
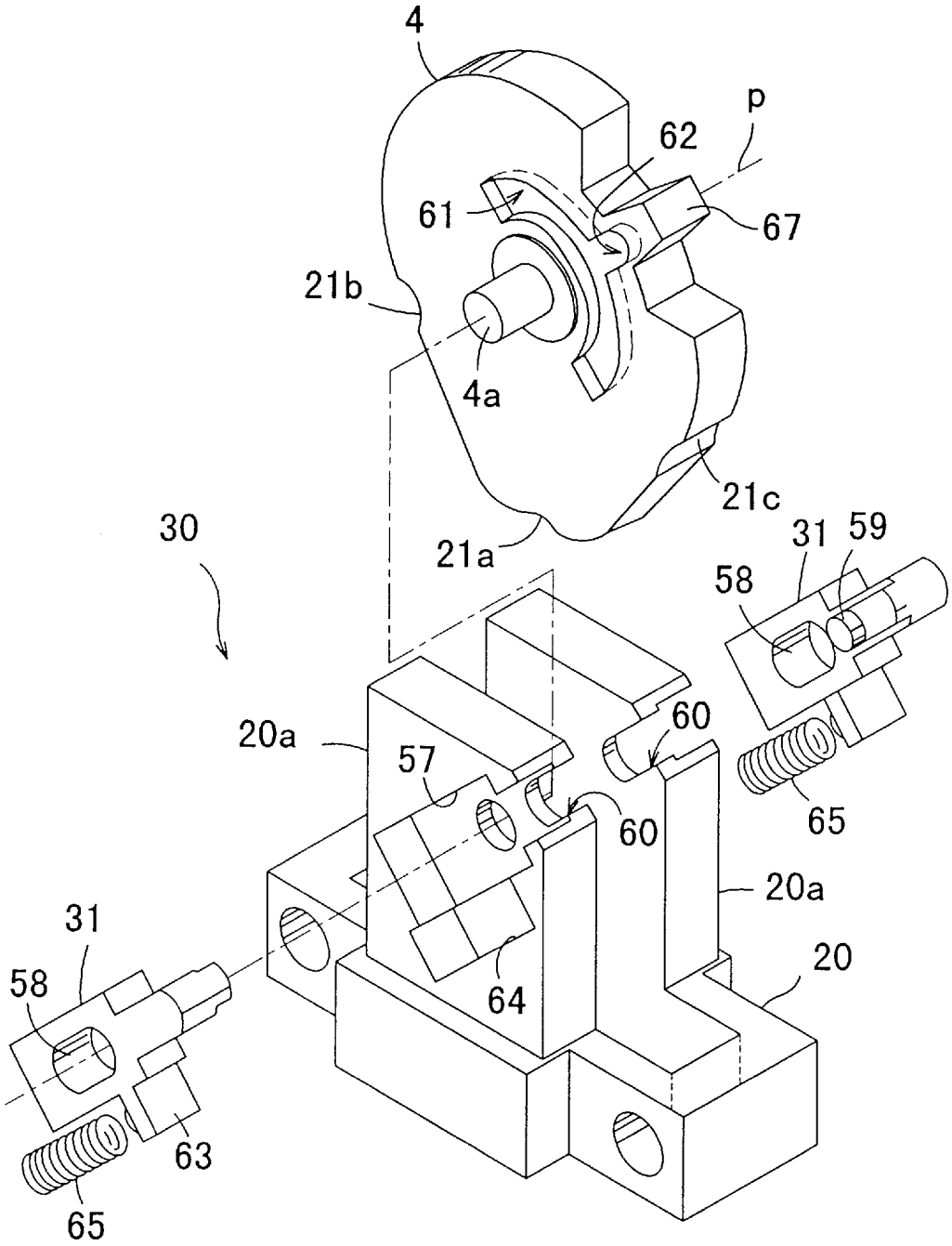
FIG. 16 is a perspective disassembled view of a cam plate and a rotation lock mechanism employed in the key switch of FIG. 13.

The rotation lock mechanism 30 of this embodiment will be described hereinafter. As shown in FIG. 16, the locking members 31 disposed in the rotation lock mechanism 30 are supported for linear slide movement in a slanting 45 degree direction along a guide groove 57 which is a concave portion formed on an external surface of each shaft support wall 20*a* of front and back in the fulcrum bracket 20 as a support member, and a rotary shaft 4*a* of the cam plate 4 projecting from the bottom wall of the guide groove 57 is inserted into elongated apertures 58 formed in the locking members 31.

Figure 17:
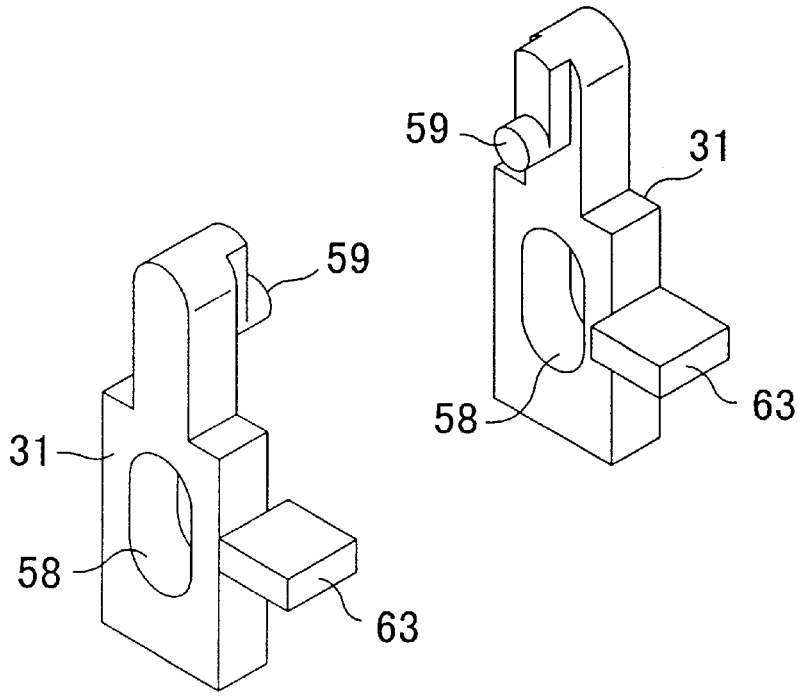
FIG. 17 is a bottom perspective view of the rotation lock mechanism of FIG. 16.

As shown in FIG. 17, a lock pin 59 is disposed on an inner side of the locking member 31, and projects toward the cam plate 4 through a cut out portion 60 formed on a corner of each shaft support wall 20*a*. On the front and back side walls of the cam plate 4 there are formed circular arc concave grooves 61 engaged by the lock pins 59. A lock groove 62 directed in a radial and outward direction is formed in the middle of the circular arc concave groove 61. As the locking member 31 is slid toward slant upward and the lock pin 59 enters the lock groove 62, the lock preventing the cam plate 4 from rotation is provided. As the locking member 31 is slid toward slant downward whereby the lock pin 59 is disengaged from the lock groove 62 and enters the circular arc concave groove 61, the lock release allowing the cam plate 4 to freely rotate is provided.

A spring receive piece 63 projects from a side of the locking member 31, and actuated by the elastic reset force of the spring 65 accommodated in a spring receive concave portion 64 formed on each axial support wall 20*a*, whereby the locking members 31 are slidably urged to the slant upper lock position.

Figure 18:
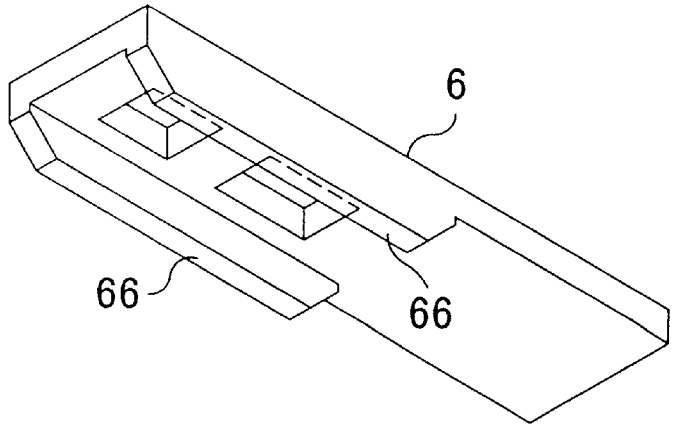
FIG. 18 is a bottom perspective view of a key inserted into the key switch of FIG. 14.

The rotational lock mechanism 30 in this embodiment is thus constructed. In the initial position when a key is pulled out, the locking members 31 are slid and urged to the slant upper lock position whereby the cam plate 4 is prevented from its rotation. As a normal key 6 shown in FIG. 18 is inserted, the locking members 31 are moved to the lock release position in a slant downward direction against the springs 65. Its subsequent key insertion allows the cam plate 4 to rotate.

Figure 19:
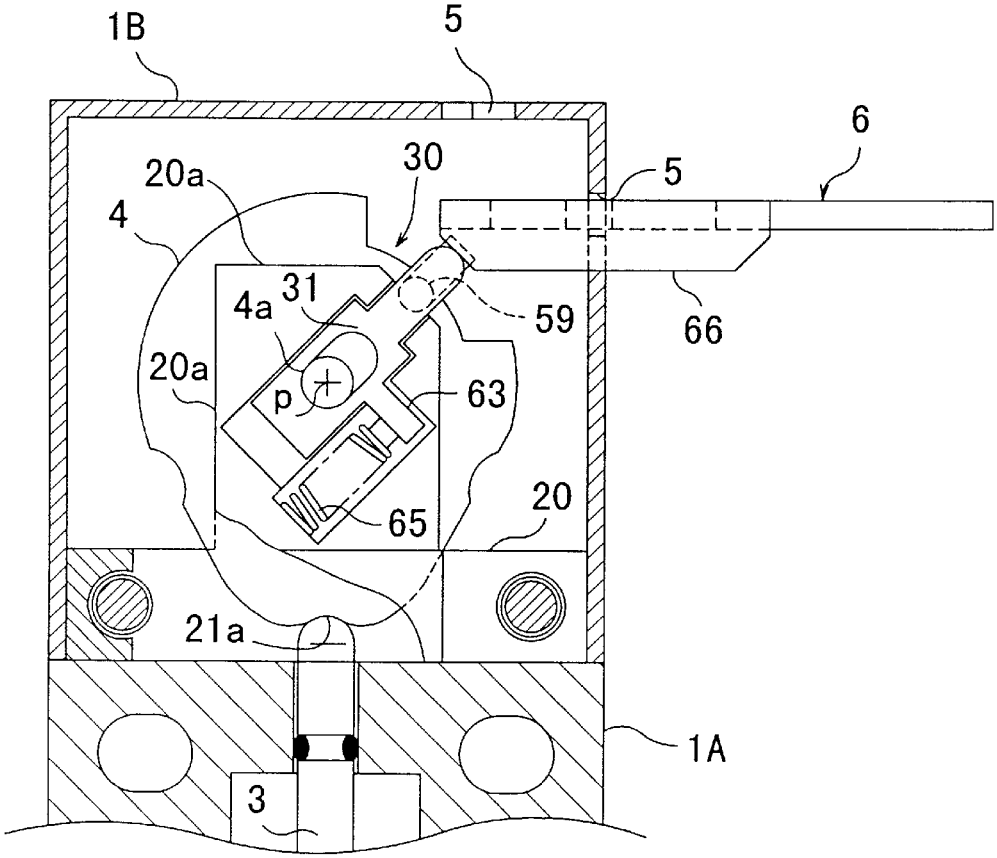
FIG. 19 at (a) shows a vertically sectional front view of a major portion of the key switch of FIG. 14 in the initial position where a key is inserted into a key insertion opening or a side wall of the switch, and at (b) shows a front view of its cam member.
Figure 19:
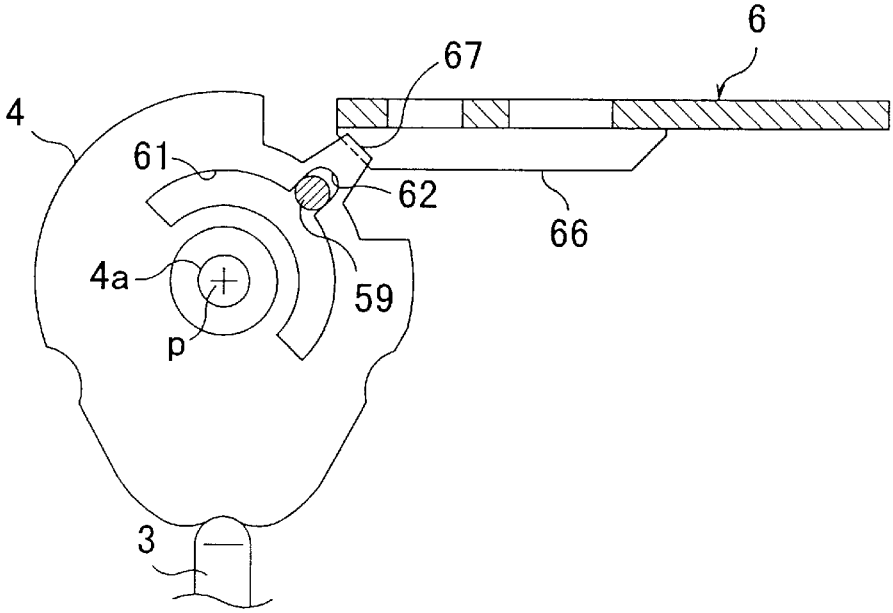
Figure 20:
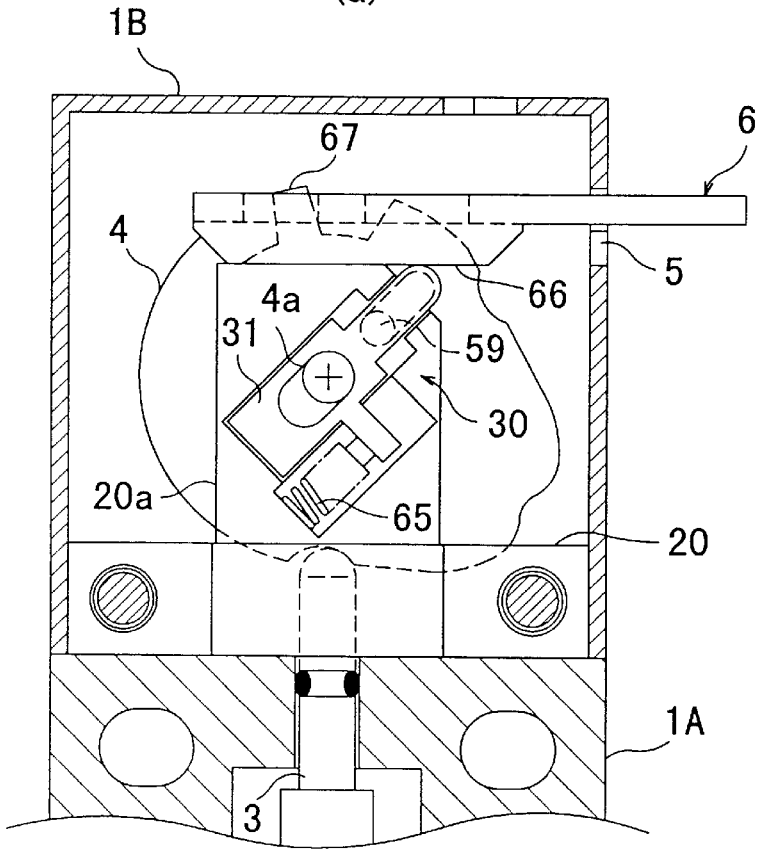
FIG. 20 at (a) shows is a vertically sectional front view of the major portion of the key switch of FIG. 19 after completing the key insertion, and at (b) shows a front view of its cam member.
Figure 20:
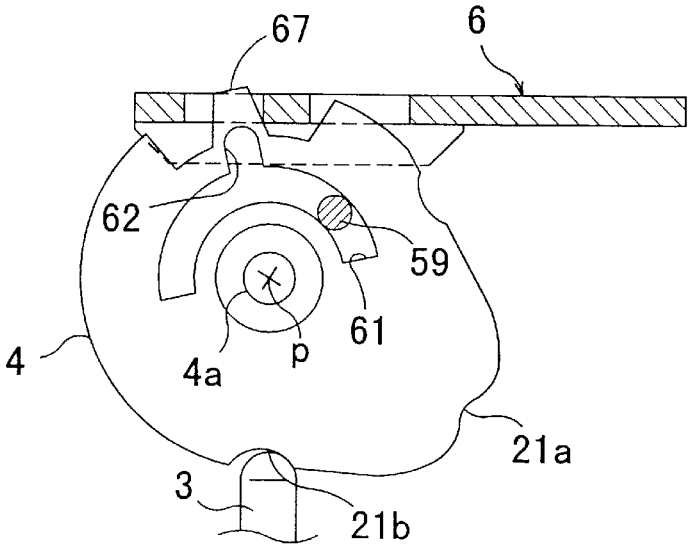

FIGS. 19 and 20 show a switching operation when a key is inserted through a side wall. As a normal key 6 is inserted into a key insertion opening 5 as shown in FIG. 19, first, tips of the operation ribs 66 disposed on both sides of a lower wall of the key 6 come into contact with upper ends of the locking members 31 in the lock position.

As the key 6 is further pushed, the locking members 31 are displaced backward to the slant downward lock release position against the springs 65. As the key 6 is subsequently pushed, a nail portion 67 formed on an peripheral of the cam plate 4 is engaged to be stopped by the key 6, the cam plate 4 largely rotates counterclockwise, and the plunger 3 is pushed. If the key 6 is pulled out, the cam plate 4 is hooked and rotated clockwise through the nail portion 67 and returns to its original position whereby locking is again activated.

Figure 21:
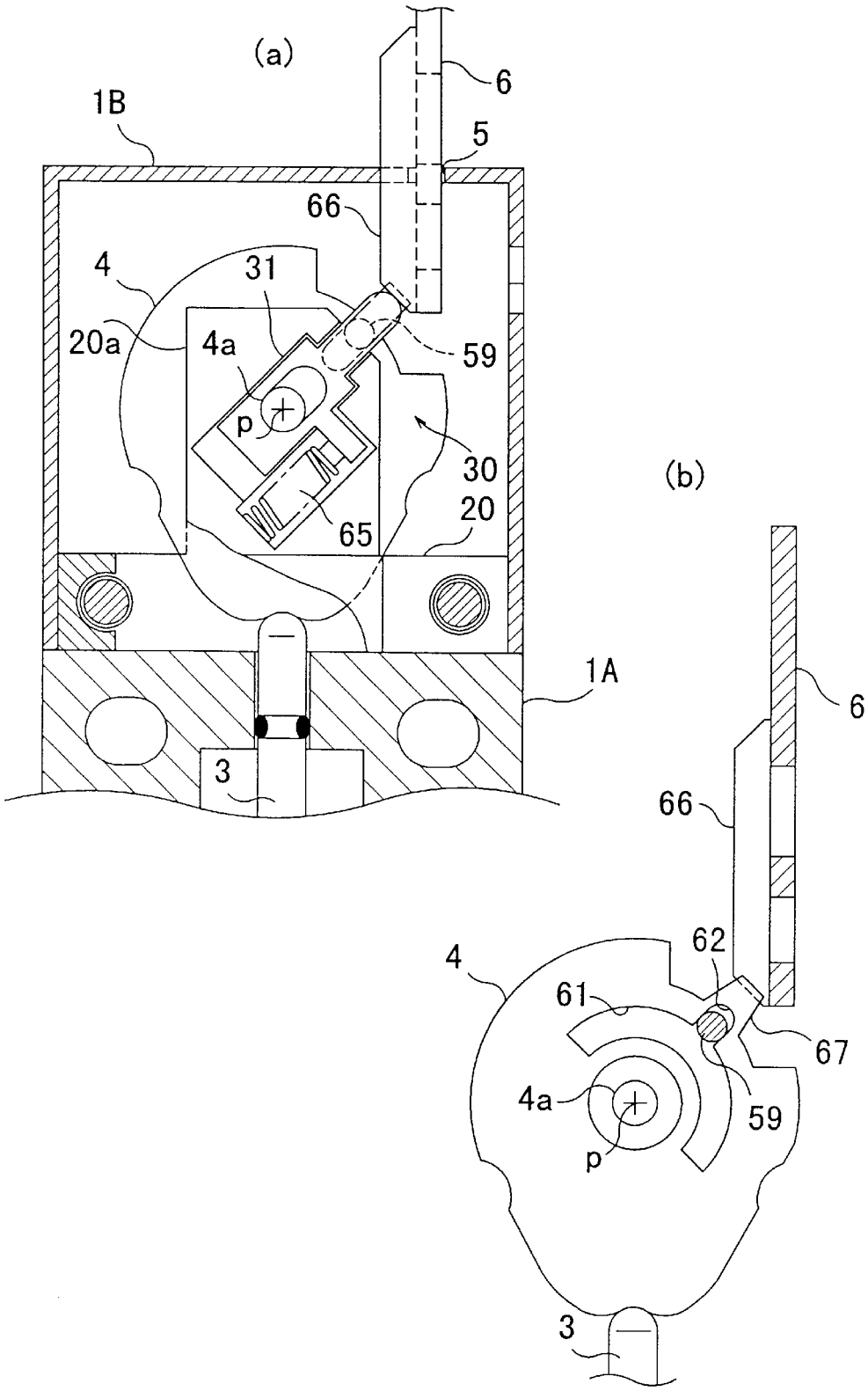
FIG. 21 at (a) shows a vertically sectional front view of a major portion of the key switch of FIG. 14 in the initial position where a key is inserted into a key insertion opening of an upper wall of the switch, and at (b) shows a front view of its cam member.
Figure 22:
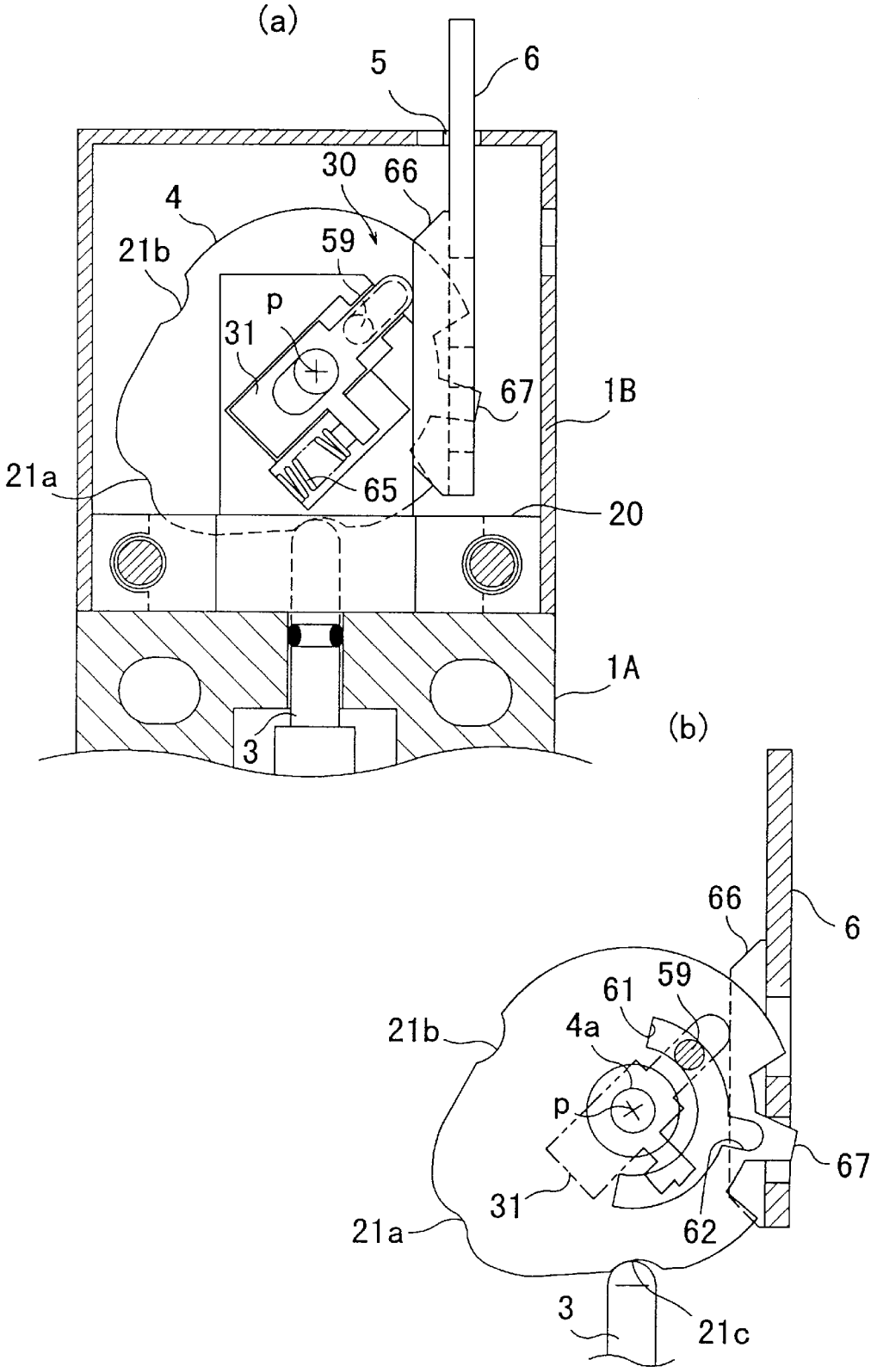
FIG. 22 at (a) shows is a vertically sectional front view of the major portion of the key switch of FIG. 21 after completing the key insertion, and at (b) shows a front view of the cam member.

FIGS. 21 and 22 show a switching operation when a key is inserted through an upper wall, in which the rotational direction of the cam plate 4 is just reversal to the foregoing but the switch operation is same as the above-described operation.

(Third Embodiment)

In FIGS. 23 to 31, there is shown a key switch according to a third embodiment of this invention, which is a modification of the rotational lock mechanism 30 of the foregoing second embodiment, and only a modified internal structure of the head housing 1B is shown.

Figure 23:
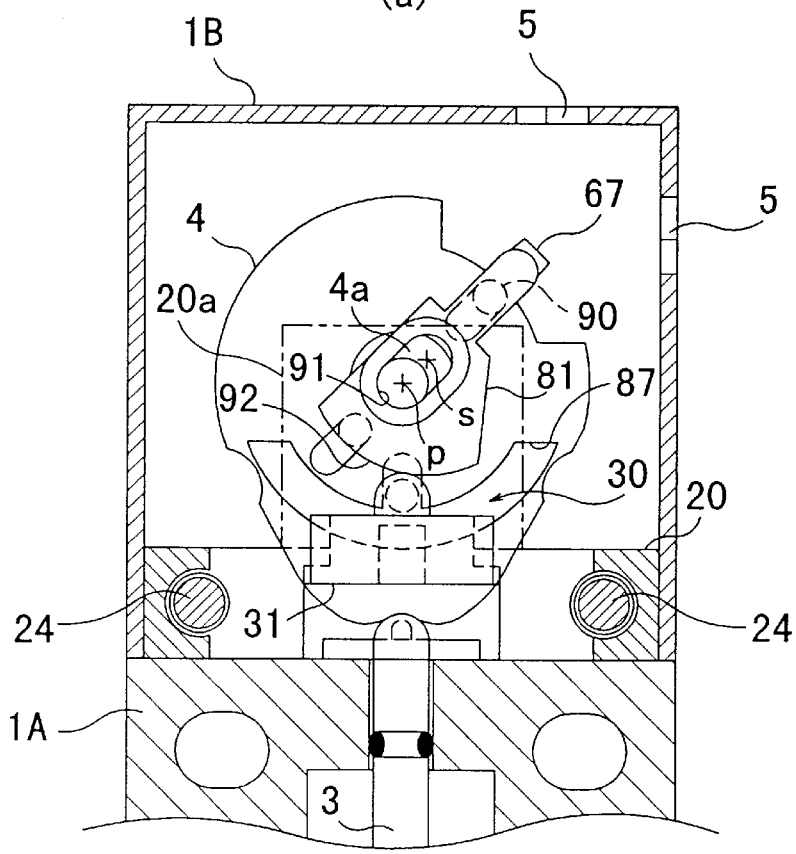
FIG. 23 at (a) shows a vertically sectional front view of a major portion of a key switch in an initial position as a third embodiment of this invention, and at (b) shows a front view of a cam member employed in the switch.
Figure 23:
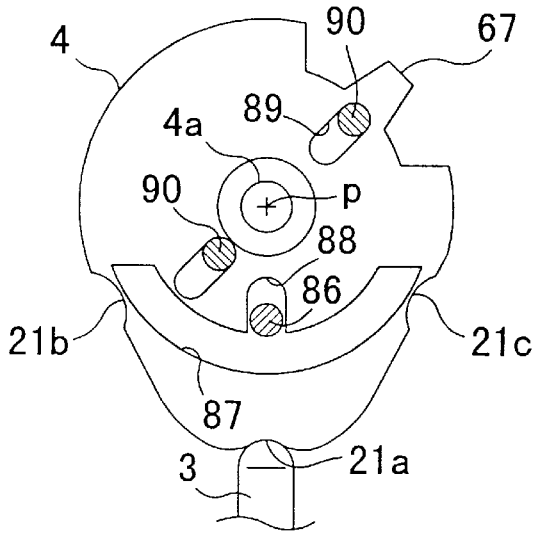
Figure 24:
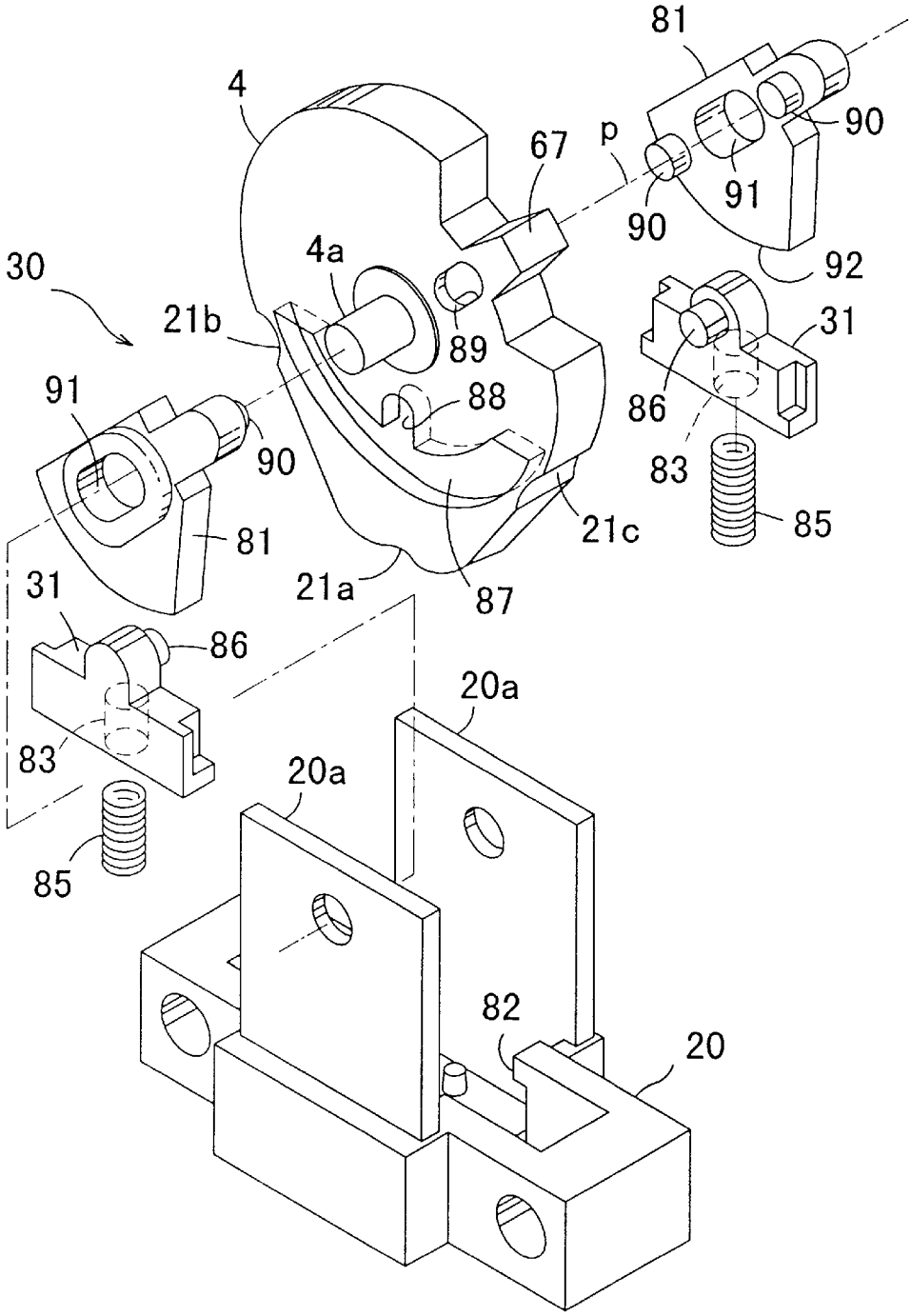
FIG. 24 is a perspective disassembled view of a cam plate and a rotation lock mechanism employed in the key switch of FIG. 23.
Figure 25:
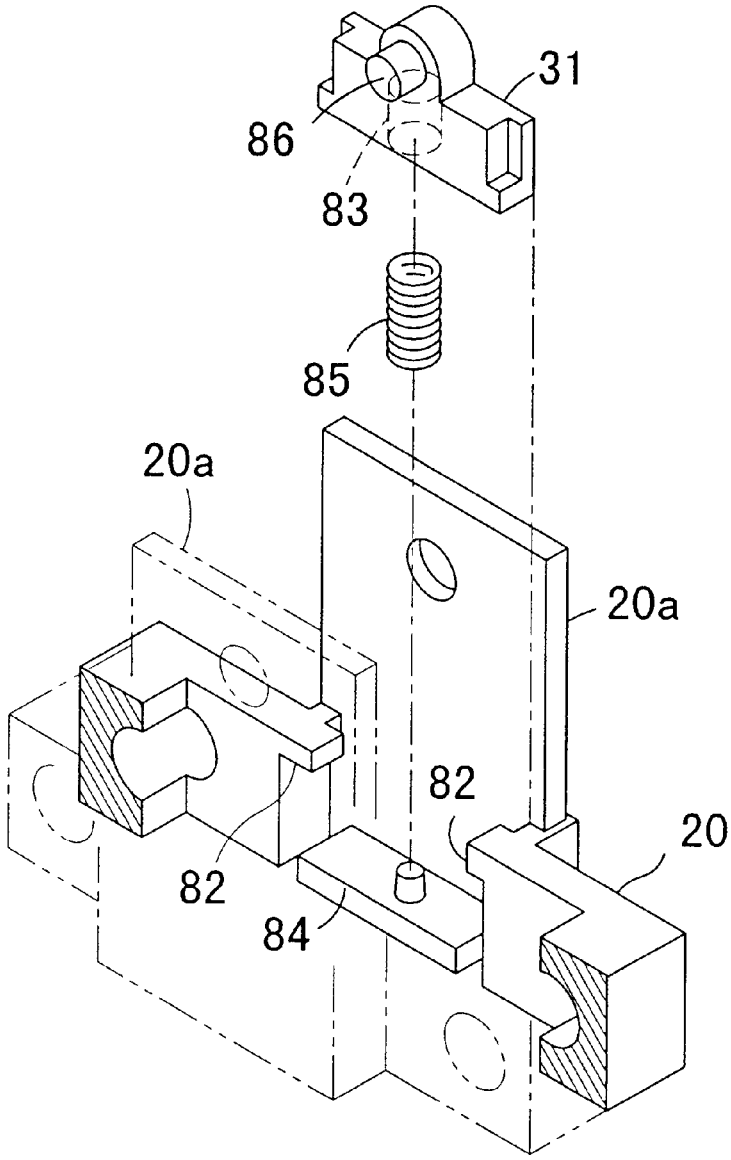
FIG. 25 is a perspective disassembled view of the rotation lock mechanism of FIG. 24 which is vertically sectioned.

As shown in FIGS. 23 and 24, the rotation lock mechanism 30 includes locking members 31 to actuate the front and back side walls of the cam plate 4, and an intermediate operation member 81 for actuating the locking members 31 by contact. As shown also in FIG. 25, the locking members 31 are engaged with and supported along internal surfaces of the axial support walls 20*a* in fulcrum brackets 20 for axial-supporting a cam plate 4 for a vertical movement, and are prevented from slipping out upward by stoppers 82 disposed on the fulcrum brackets 20. Springs 85 are disposed across spring receipt concave portions 83 engaged with lower end wall of the locking members 31 and spring receipt blades 84 disposed lower portions of the fulcrum brackets 20, and the locking members 31 are urged upward by the recoil strength.

Lock pins 86 are disposed on inner side walls of the locking members 31, and circular arc concave grooves 87 engaged by the locking pins 86 are disposed on the front and back side walls of the cam plate 4. Locking grooves 88 directing upward are disposed in the middle of the circular arc concave groove 87. When the locking members 31 are slid upward and the lock pins 86 are engaged with the locking grooves 88, the locking is made to prevent the cam plate 4 from rotating. When the locking members 31 are slid downward and the lock pins 86 are disengaged from the locking grooves 88 to enter the circular arc concave grooves 87, the lock release is made to allow the cam plate 4 to freely rotate.

Figure 26:
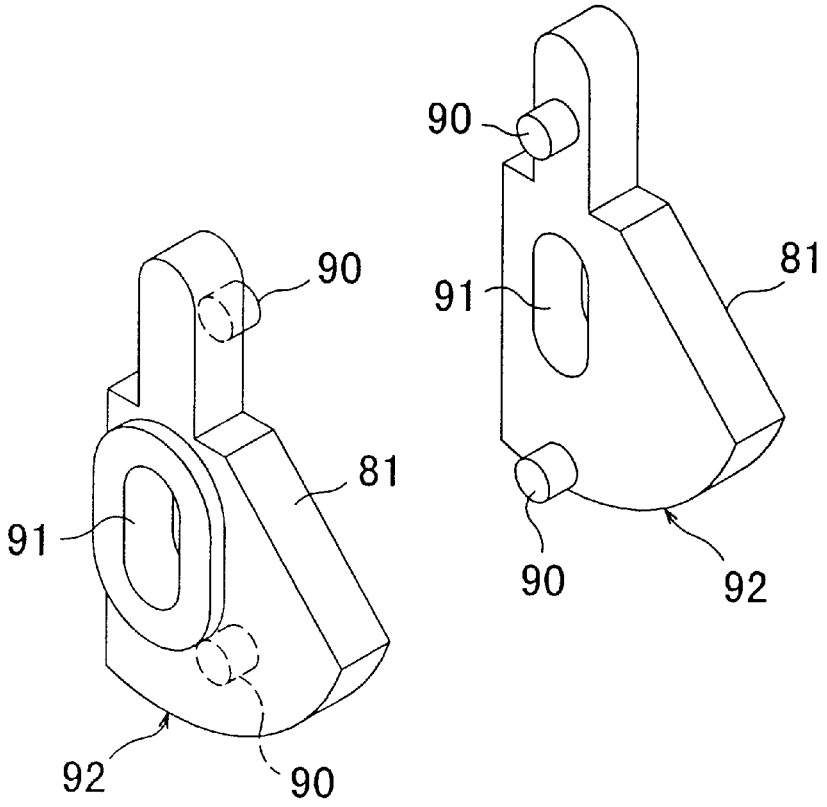
FIG. 26 is a perspective view of the rotation lock mechanism of FIG. 24.

As shown in FIG. 26, the intermediate operating members 81 are respectively arranged between the front and back side walls of the cam plate 4 and the inner walls of the axial support walls 20*a* in the fulcrum brackets 20, and a pair of guide pins 90 projecting inner walls of the intermediate operating members 81 are engaged with a pair of guide grooves 89 formed on the front and back side walls of the cam plate 4, whereby the intermediate operating members 81 are slid within a predetermined travel along the guide grooves and are rotated in accordance with the rotation of the cam plate. A rotary axis 4*a* of the cam plate 4 pierces elongate holes 91 formed in the intermediate operating members 81.

A circular arc cam surface 92 centered at an upper central axis "s" of the elongate hole 91 is disposed at a lower of each intermediate operating member 81, and arranged confronting an upper end of the locking member 31. Accordingly, as shown in FIG. 23, when the intermediate operating member 81 slides upward, the locking member 31 is urged to slide upward and the lock pin 86 is engaged with lock groove 88, thereby providing the locking to prevent the cam plate 4 from rotating. When the intermediate operating member 81 is slid downward, the locking member 31 slides downward by contact through the circular arc cam surface 92 and the locking pin 86 is disengaged from the locking groove 88 and enters the circular concave groove 87, thereby providing a lock release where the cam plate 4 rotates left and right.

Figure 27:
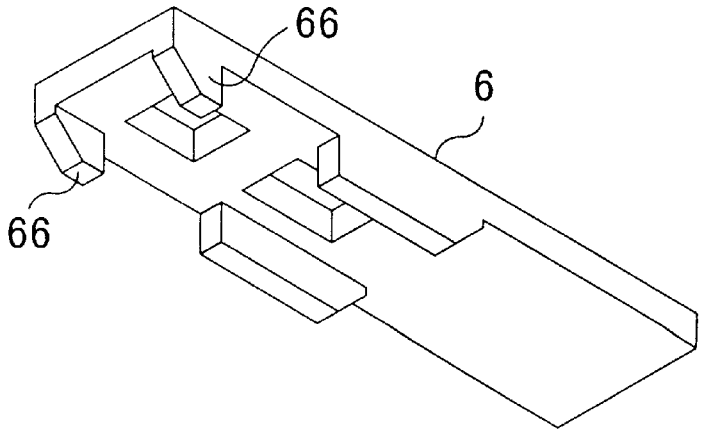
FIG. 27 is a bottom perspective view of a key inserted into the key switch of FIG. 23.

The rotational lock mechanism 30 is thus constructed in this embodiment. In the initial position where a key is pulled out, the intermediate operating member 81 and the locking member 31 are urged to be slid to the upper lock position and the cam plate 41 is prevented from rotating. As described below, when the normal key 6 shown in FIG. 27 is inserted into the key insertion opening 5 of a side wall or an upper wall, the locking member 31 is displaced backward into the lower lock release position through the intermediate operating member 81 and the cam plate 4 is rotated by the subsequent key insertion.

Figure 28:
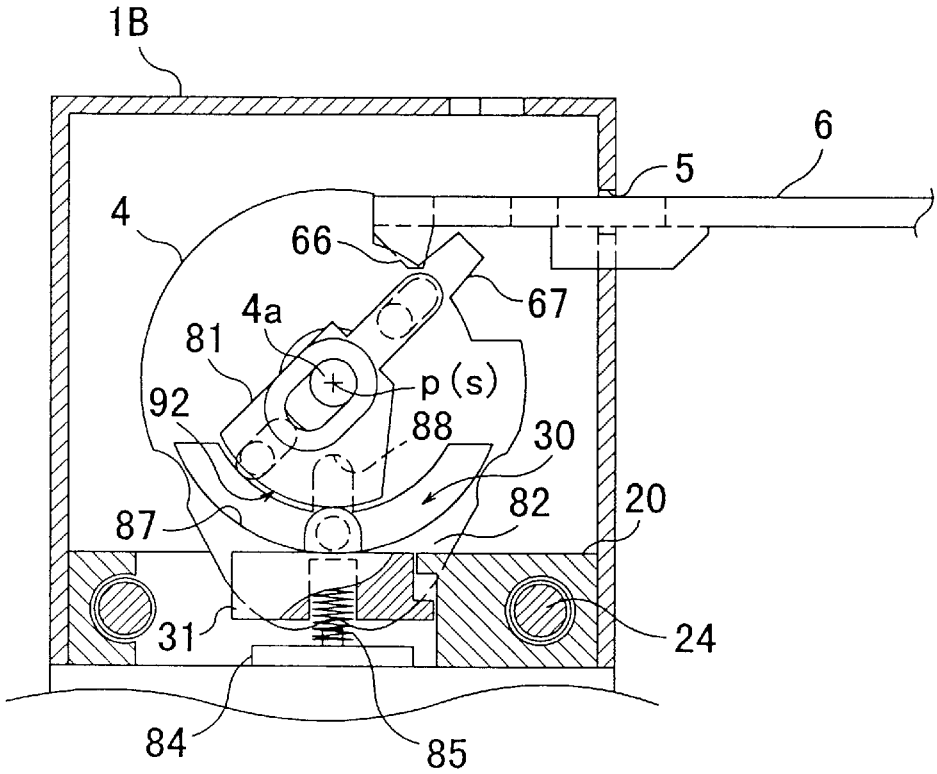
FIG. 28 at (a) shows a vertically sectional front view of a major portion of the key switch of FIG. 23 in the initial position where a key is inserted into a key insertion opening of a side wall of the switch, and at (b) shows a front view of its cam member.
Figure 28:
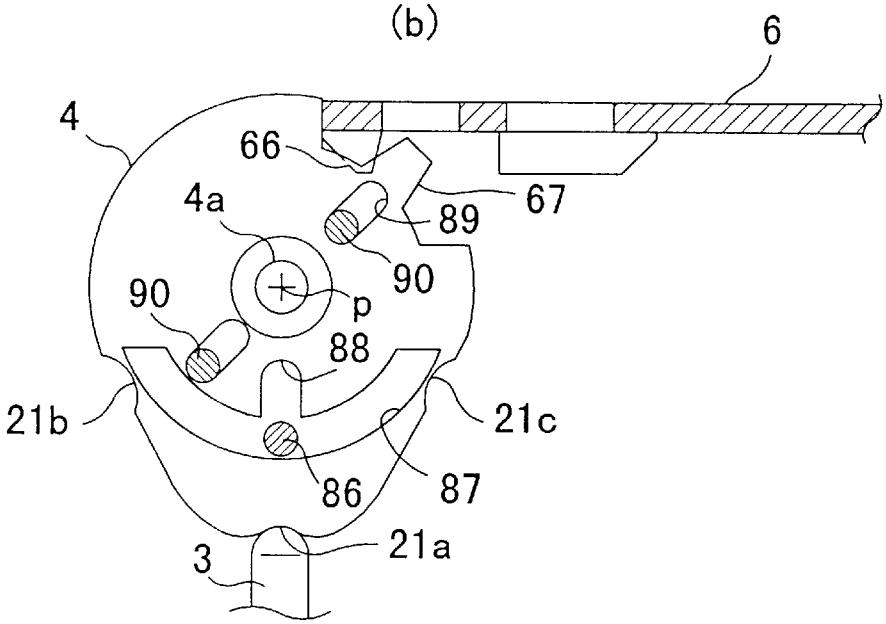
Figure 29:
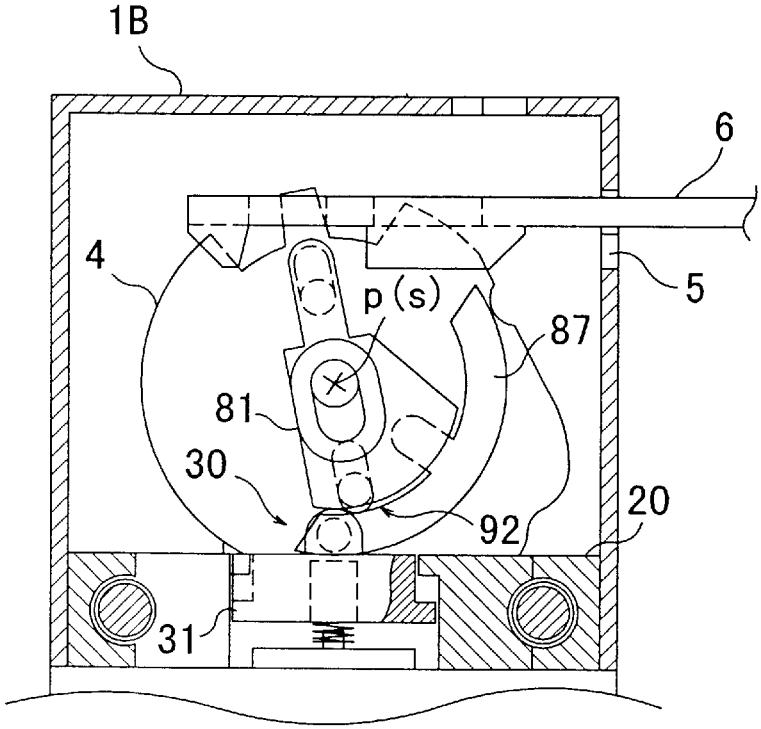
FIG. 29 at (a) shows is a vertically sectional front view of the major portion of the key switch of FIG. 28 after completing the key insertion, and at (b) shows a front view of its cam member.
Figure 29:
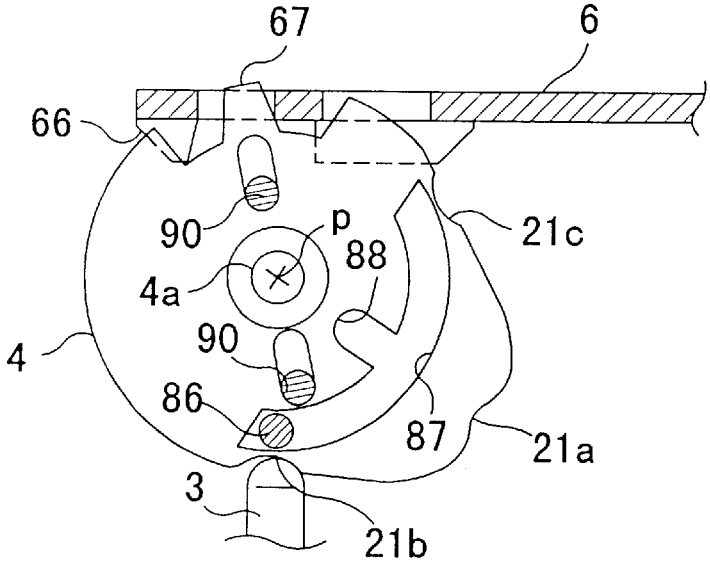

In FIGS. 28 and 29, a switching operation by the key insertion from the side wall is shown. As shown in FIG. 28, when the normal key 6 is inserted into the key insertion opening 5 of the side wall, tips of the operating ribs 66 disposed on both sides of a lower face of the key 6 contact and push the intermediate operating members 81 downward, whereby the locking members 31 in the lock position are displaced backward to the lock release position against the springs 85.

As shown in FIG. 29, when the key 6 is further inserted, a nail portion 67 disposed on a peripheral of the cam plate 4 is hooked by the key 6 and the cam plate 4 largely rotates counterclockwise, whereby the intermediate operating members 81 are rotated together with the cam plate 4. Then, the intermediate operating members 81 are displaced downward so that the rotation central axis "p" of the cam plate 4 coincides with the upper central axis "s" of the elongate hole 91. When the intermediate operating members 81 rotate together cam plate 4, the circular arc cam surfaces 92 of the intermediate operating members 81 rotate at the center of the central axis "s" to contact and retain the locking members 31 in the lock position. If the key 6 is pulled out, the cam plate 4 is hooked and rotated clockwise by the nail portion 67 to return into the original position where the lock is restored.

Figure 30:
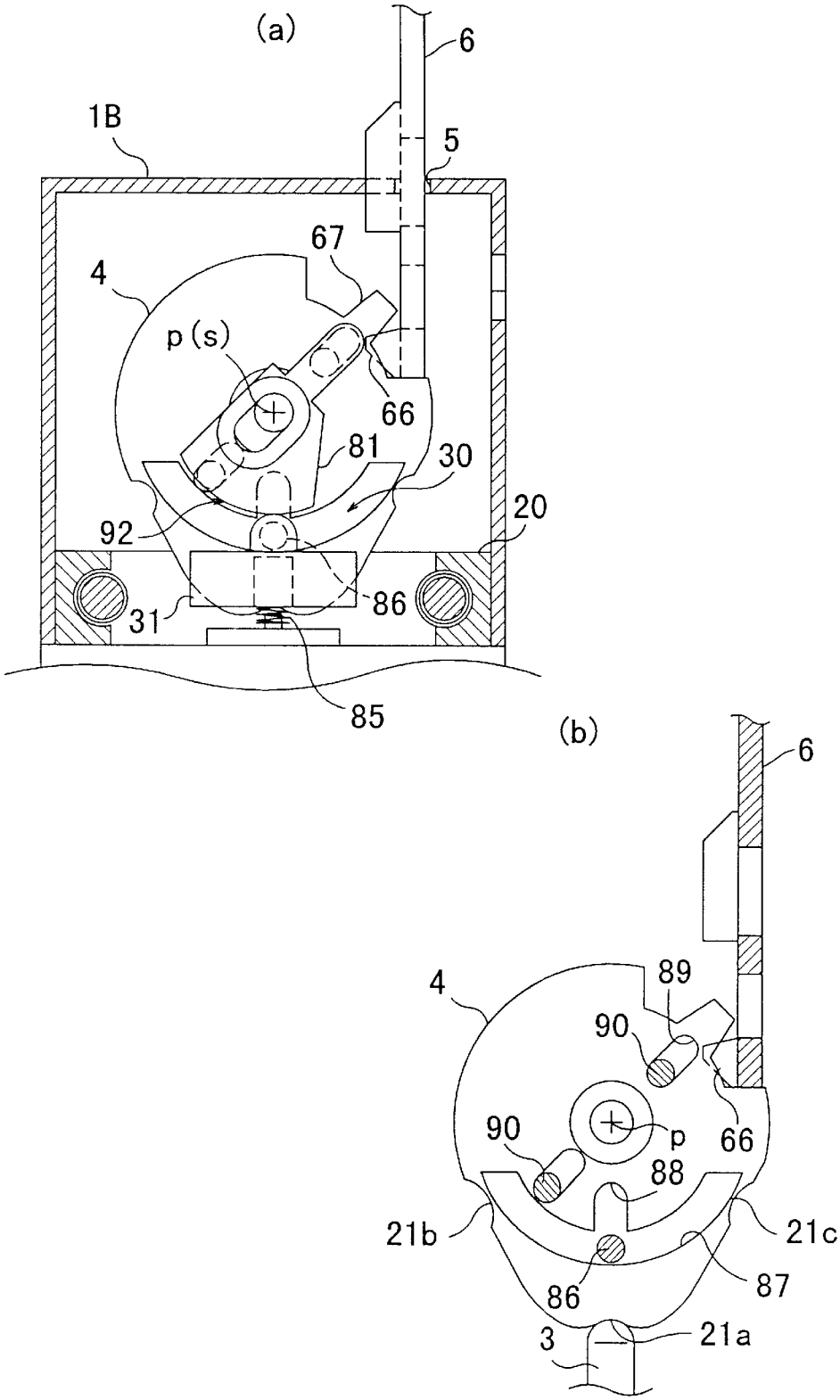
FIG. 30 at (a) shows a vertically sectional front view of a major portion of the key switch of FIG. 23 in the initial position where a key is inserted into a key insertion opening of an upper wall of the switch, and at (b) shows a front view of its cam member.
Figure 31:
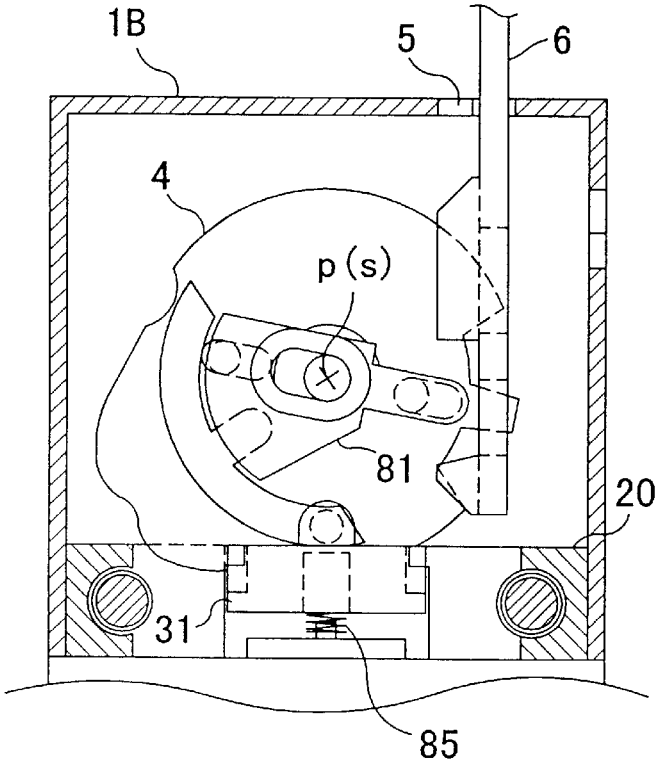
FIG. 31 at (a) shows a vertically sectional front view of the major portion of the key switch of FIG. 30 after completing the key insertion, and at (b) shows a front view of its cam member.
Figure 31:
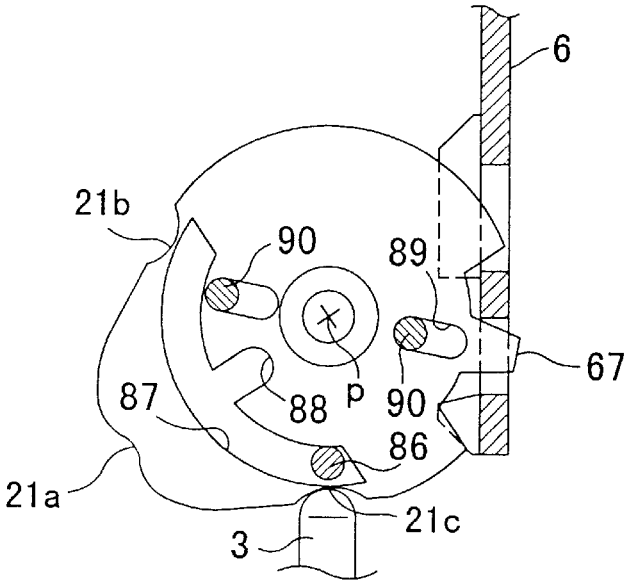
Figure 32:
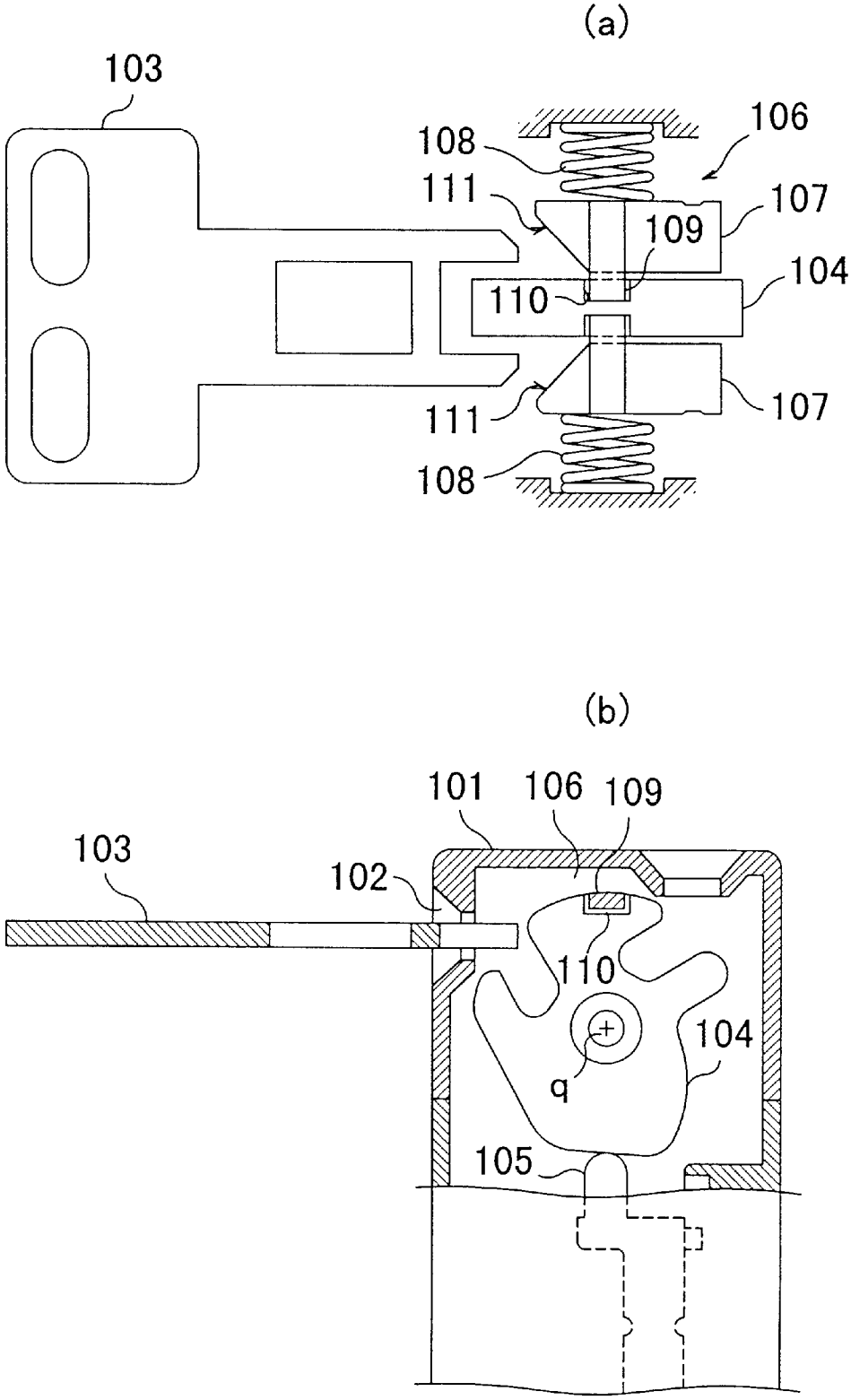
FIG. 32 (PRIOR ART)
FIG. 32 at (a) shows a plan view of a major portion of a conventional key switch in its initial position, and at (b) shows its sectional partial side view.
Figure 33:
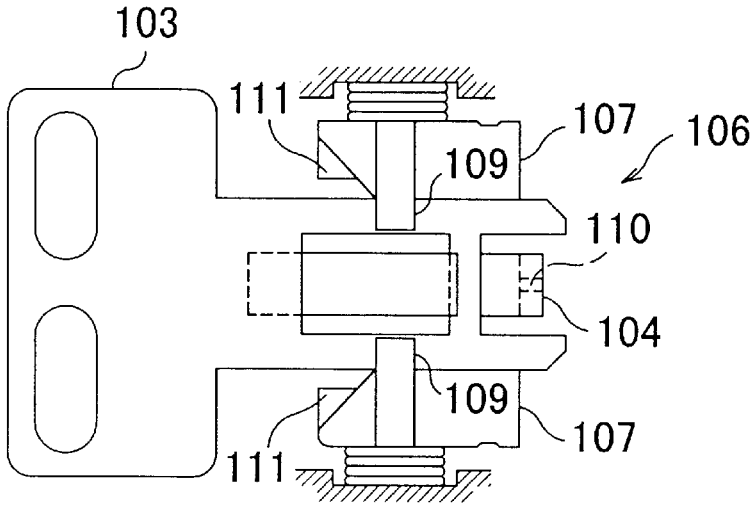
FIG. 33 (PRIOR ART)
FIG. 33 at (a) shows a plan view of the major portion of the conventional key switch where the insertion of a key is completed, and at (b) shows its sectional partial side view.
Figure 33:
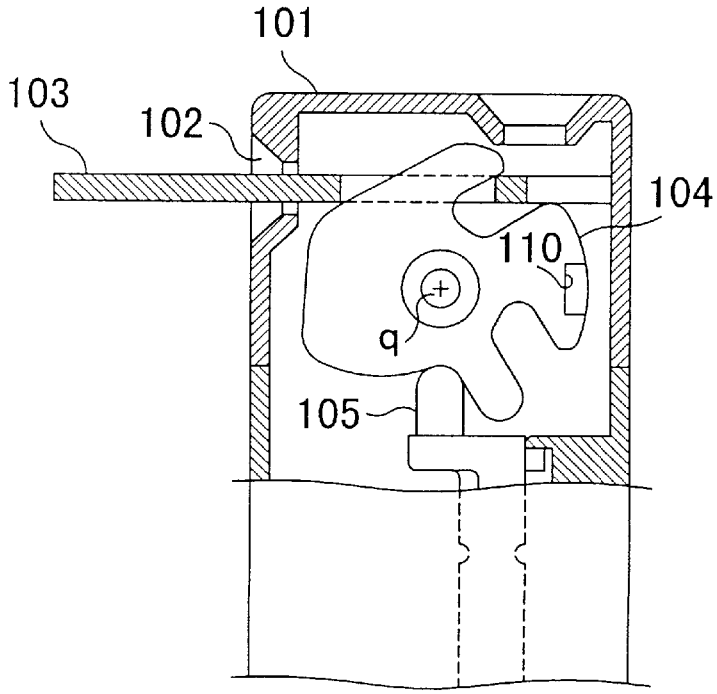
FIG. 33 (PRIOR ART)

In FIGS. 30 and 31, there is shown the switching operation by the key insertion from the upper wall, in which the operation is executed as well as the operation from the side wall but the rotation direction of the rotation cam 4 is just reverse.

(Other Embodiments)

The foregoing embodiments of this invention may be modified as described below.

(1) In the first embodiment, a single plate spring which is united by a spring blade sliding on an inner wall of the upper wall of the housing and a spring blade sliding on an inner wall of the side wall of the housing, instead of the spring 32 urging the locking members 31 downward and the spring 33 urging the same horizontally.

(2) In the respective embodiments, a lock pin is disposed on side of the cam plate 4, and an engagement means engaging with the lock pin is disposed on side of the locking members 31.

(3) There may be disposed a rotation lock mechanism in which a single locking member 31 is disposed to actuate one side wall of the cam plate 4.

(4) The locking member 31 may be engaged with a peripheral surface of the cam plate 4.

(5) The engagement structure for connecting the head housing 1B with the body housing 1A in a left and right reversal relationship may be made reversed to the above-described embodiments such that a connector of a projection piece is disposed in diagonal position of a lower end of the head housing 1B and a concave connector is disposed in diagonal position of a upper end of the body housing 1A.

(6) A concave portion may be disposed on one of a front wall and a rear wall of the switching housing, and a convex portion may be disposed on the other to be engaged with the concave portion, so that a plurality of key switches are set in a parallel relationship by engaging the respective front and the back walls.

The foregoing description of the invention has been presented for purposes of illustration and description. It is not intended to be exhaustive or to limit the invention to the precise forms described, and other modifications are possible in light of the foregoing teaching.

What is claimed is:

1. A key switch, comprising:

a cam member having side surfaces and having a vertical rotation face on a rotation axis thereof, said cam member rotating in accordance with insertion of a key adapted to be inserted into a key insertion opening on said key switch, a plunger coming into contact with a circumferential cam side of said cam member, a switch mechanism actuated by said plunger so as to be displaced in accordance with the rotation of said cam member, and a rotation lock mechanism for locking the rotation of said cam member when the key is pulled, said rotation lock mechanism comprising a pair of locking members each including a lock pin projecting to one of said side surfaces of said cam member which can be displaced in a direction parallel to the vertical rotation face of said cam member and a spring urging said locking member toward a position at which said pair of locking members can engage engagement portions on the cam member, said locking members being disposed to be displaced to a lock release position upon contact with said key resisting said spring.

2. A key switch, comprising:

a cam member having side surfaces and a vertical rotation face on a rotation axis thereof rotating in accordance with insertion of a key adapted to be inserted into a key insertion opening on said key switch, a plunger coming into contact with a circumferential cam side of said cam member, a switch mechanism actuated by said plunger so as to be displaced in accordance with the rotation of said cam member, and a rotation lock mechanism for locking the rotation of said cam member when the key is pulled, said rotation lock mechanism comprising a pair of locking members each including a lock pin projecting to one of said side surfaces of said cam member which can be displaced in a direction parallel to the vertical rotation face of said cam member, an intermediate operating member which comes into contact with said locking member for moving said locking member, and a spring urging said locking member toward a position at which said pair of locking members can engage engagement portions on the cam member, said locking members being disposed to be displaced to a lock release position resisting said spring by displacing said intermediate operating member by the insertion of said key.

3. A key switch according to claim 2, in which said intermediate operating member is supported together with said cam member and rotates together with said cam member in accordance with the rotation of the cam member after lock release, and said intermediate operating member includes a circular arc cam side for forcing said locking member into the lock release position.

4. A key switch according to one of claim 1 further comprising a support member axially supporting said cam member, in which said support member supports said locking member and said lock urging spring.

5. A key switch according to claim 4 in which said support member includes an axial support wall for axially supporting said cam member, an external side surface of said axial support wall being provided with a concave portion to be engaged by said locking member and said spring member, and said locking member being engaged with concave portion for a displacement movement.

6. A key switch according to claim 1 further including a switch housing including a body housing enclosing said switch mechanism and said plunger and a head housing having said key insertion opening for enclosing said cam member and said rotation lock mechanism which is removably connected with an upper end of said body housing.

7. A key switch according to claim 6, in which said key insertion opening is disposed on a side wall and an upper wall of said head housing, and said plunger projecting into said head housing from a center of an upper wall of said body housing is actuated by said cam member.

8. A key switch according to claim 7, in which a pair of first connection portions are point-symmetrically disposed at corners corresponding to diagonal positions of the upper wall of said body housing, second connection portions are disposed at corners corresponding to diagonal positions of a lower wall of said head housing to be engaged with said first connection portions, and the engaged portions of said first and second pairs of connection portions are pierced and tightened by screws.

9. A key switch according to claim 1, in which said body housing at a lower end thereof has an opening, and is successively packed with an inelastic member, a seal member of an elastic material, a bottom cover of inelastic material after said switch mechanism is inserted into said body housing, and said body housing is mounted by a support member piercing said inelastic member and said bottom cover, and said support member allows said inelastic member and said bottom cover to press said seal member and be supported to said body housing.

* * * * *